US005394931A

United States Patent [19]

Shiina et al.

[11] Patent Number: 5,394,931

[45] Date of Patent: Mar. 7, 1995

[54] ALUMINUM-BASED ALLOY CAST PRODUCT AND PROCESS FOR PRODUCING THE SAME

[75] Inventors: Haruo Shiina; Nobuhiro Saito; Takeyoshi Nakamura, all of Saitama, Japan

[73] Assignee: Honda Giken Kogyo Kabushiki Kaisha, Tokyo, Japan

[21] Appl. No.: 119,066

[22] PCT Filed: Jan. 12, 1993

[86] PCT No.: PCT/JP93/00030

§ 371 Date: Nov. 8, 1993

§ 102(e) Date: Nov. 8, 1993

[87] PCT Pub. No.: WO/9313895

PCT Pub. Date: Jul. 22, 1993

[30] Foreign Application Priority Data

| | | | |
|---|---|---|---|
| Jan. 13, 1992 | [JP] | Japan | 4-021628 |
| Jan. 13, 1992 | [JP] | Japan | 4-021629 |
| Jan. 13, 1992 | [JP] | Japan | 4-021630 |
| Mar. 10, 1992 | [JP] | Japan | 4-086100 |
| Mar. 10, 1992 | [JP] | Japan | 4-086101 |

[51] Int. Cl.[6] ..... B22D 17/00; B22D 23/00

[52] U.S. Cl. ..... 164/113; 164/900

[58] Field of Search ..... 164/113, 900

[56] References Cited

U.S. PATENT DOCUMENTS

| | | | |
|---|---|---|---|
| 4,771,818 | 9/1988 | Kenney | 164/900 |
| 5,186,236 | 2/1993 | Gabathuler et al. | 164/900 |

FOREIGN PATENT DOCUMENTS

| | | |
|---|---|---|
| 0200349 | 11/1986 | European Pat. Off. . |
| 0242347 | 11/1988 | European Pat. Off. . |
| 488694 | 3/1973 | Japan . |
| 60-149751 | 8/1985 | Japan . |
| 2190404 | 7/1990 | Japan . |
| 347951 | 7/1991 | Japan . |

OTHER PUBLICATIONS

Patent Abstract of JP 4033761 Feb. 1992.

Patent Abstract of JP 60152358 Aug. 1985.

Japan Casting Society "Rev. 4 Casting Handbook" (Jan. 20, 1986) Maruzen–author (Text in Japanese).

*Primary Examiner*—Kuang Y. Lin

*Attorney, Agent, or Firm*—Lyon & Lyon

[57] ABSTRACT

A process for producing an aluminum-based alloy cast product, includes the steps of: preparing a casting material having an aluminum-based hypo-eutectic alloy composition with solid and liquid phases coexisting therein; and subjecting the casting material to a casting under pressure. At this casting step, the casting material is passed through a gate in a casting mold under conditions of a viscosity $\mu$ in a range of 0.1 Pa·sec$\leqq\mu\leqq$2,000 Pa·sec and a Reynolds number in a range of Re$\leqq$1,500.

27 Claims, 14 Drawing Sheets

100μm

100μm

100μm

100μm

ALUMINUM-BASED ALLOY CAST PRODUCT AND PROCESS FOR PRODUCING THE SAME

FIELD OF THE INVENTION

The present invention relates to a process for an aluminum-based alloy cast product and a process for producing the same, and particularly, to a process for producing an aluminum-based alloy cast product by preparing a casting material having solid and liquid phases coexisting therein and then subjecting the casting material to a casting under pressure, and to an aluminum-based alloy cast product.

The term "casting material" used herein means a semi-solidified material prepared by cooling a molten metal having an aluminum-based hypo-eutectic alloy composition, or a semi-solidified material prepared by heating a solid material having an aluminum-based hypo-eutectic alloy composition, an aluminum-based eutectic alloy composition or an aluminum-based hyper-eutectic alloy composition. Such a process has been developed for the purpose of improving the cast quality of a cast product.

PRIOR ART

There is a conventionally known casting process using a semi-solidified material of the above-described type, which is disclosed in Japanese Patent Application Laid-open No. 152358/85.

The present inventors have made various studies about a casting process of such type using a casting material having an aluminum-based hypo-eutectic alloy composition. And as a result, they have found that a cast quality and mechanical properties of the cast product as well as the control of casting conditions are influenced by a nature of the casting material during passage through a gate, a pressurizing force on the casting material filled in a cavity, the average temperature drop rate of the molten metal in preparation of a semi-solidified material as a casting material, an area rate of initial crystals $\alpha$-Al having a shape factor F equal to or more than 0.1 in a solid material used for preparation of a semi-molten material. Further, the inventors have found that the pressurizing force may become a factor for an operational problem such as the generation of a flash and the like, and that in order to improve the productivity without deterioration of the cast quality and mechanical properties of the cast product, it is necessary to appropriately set the speed of the casting material during passage through the gate.

If the solid phases of the semi-molten material are spherical and uniformly dispersed in liquid phases, the semi-molten material has an excellent thixotropy (deformability). Therefore, it is possible to produce a cast product having a dense metallographic structure from such semi-molten material by utilization of casting process under pressure.

From this viewpoint, a casting process using a casting material by strongly stirring a molten metal while cooling the latter to achieve a spheroidization of the solid phase, i.e., a thixocasting process has been developed.

In this casting process, however, a molten metal strongly-stirring step is required as an essential step, resulting in a troublesome operation. Thus, an improvement in this respect has been desired.

Thereupon, a process for producing a high strength structural member has been proposed which comprises the steps of: subjecting a casting material resulting from a usual casting process to a hot extrusion to comminute coarse grains and dendrites to prepare a primary solid material having a granular crystalline structure with a directional property and; subjecting the primary solid material to a straining treatment such as a stretching to prepare a secondary solid material having a granular crystalline structure with the directional property moderated; heating the secondary solid material to prepare a semi-molten material; and subjecting the semi-molten material to a forming under pressure (see Japanese Patent Application Laid-open No. 149751/85).

The above prior art process aims at spherically shaping the solid phases in the semi-molten material by subjecting the primary solid material having the granular crystalline structure with the directional property to the straining treatment. However, this prior art process suffers from a problem that it is impossible to sufficiently eliminate the directional property of the granular crystalline structure by the above-described straining treatment. For this reason, the directional property is left in the solid phase in the semi-molten material, and due to this, the semi-molten material creates a flow in a direction different from an original flow in the forming process under pressure, resulting in linear cracks produced in a structural member.

The present inventors have also made various studies of the above-described casting process using casting materials having an aluminum-based eutectic alloy composition and an aluminum-based hyper-eutectic alloy composition. As a result, they have found that the maximum grain size d of initial crystals in a solid material influences the durability of a casting mold and the mechanical properties of a cast product.

Further, a quenched and solidified aluminum alloy powder has been put to a practical use as a material having a high strength, particularly, an excellent high temperature strength, and a high rigidity, because a degree of preset freedom of its alloy composition is high, and an alloy element or elements can be added thereto in a large amount.

As described above, the quenched and solidified aluminum alloy powder has excellent mechanical properties on the one hand, but has a disadvantage that it is difficult to process on the other hand. For this reason, in order to produce a structural member from a powder of such type without deterioration of the mechanical properties, a hot extrusion has been primarily applied.

However, the hot extrusion is accompanied by a problem that a freedom degree of shape of a structural member is low and hence, it is impossible to produce a structure member having a required shape.

Thereupon, a process for producing a structure member having a relatively high freedom degree of shape has been proposed, which is disclosed in Japanese Patent Application Laid-open No. 268961/90.

In this process, an aluminum alloy powder of the above-described type is placed into a crucible, where a semi-molten material having solid and liquid phases coexisting therein is prepared in a heated condition and then, the semi-molten material is transferred into dies, where it is subjected to a forming under pressure. The reason why such a semi-molten material is used is that it prevents, to a possible extent, the losing of the mechanical properties by the quenched and solidified aluminum alloy powder.

However, it has been ascertained that the above process is accompanied by following problems, because an infinite number of voids are present within an aggregate of the aluminum alloy powder:

A soaking degree (temperature equalization degree) of the semi-molten material is liable to be degraded, because these voids obstruct the heat conduction between particles of the powder during heating. As a result, a flowing of the whole semi-molten material is not performed uniformly in the course of the forming under pressure. Consequently, when a shape of the member is complicated, molding failures such as cutouts are liable to be produced in the resulting member. In addition, cavities are liable to be produced in a resulting member due to the above-described voids and hence, a sufficient strength can not be obtained in some cases.

SUMMARY OF THE INVENTION

It is a first object of the present invention to provide a producing process, wherein the cast quality and mechanical properties of a cast product can be enhanced by specifying the nature of a casting material during passage through a gate.

To achieve the above object, according to the present invention, there is a process for producing an aluminum-based alloy cast product by casting, comprising the steps of: preparing a casting material having an aluminum-based hypo-eutectic alloy composition in which solid and liquid phases coexist; and casting the casting material under pressure; at the casting step, the casting material being passed through a gate in a casting mold under conditions of a viscosity $\mu$ of the casting material in a range of 0.1 Pa·sec$\leqq\mu\leqq$2,000 Pa·sec and a Reynolds number Re equal to or less than 1,500.

If the viscosity $\mu$ is set at a value in the above range, it is possible to prevent a gas inclusion by the casting material and thus prevent the creation of pores in the cast product to provide an increased cast quality. However, if the viscosity $\mu$ of the casting material is less than 0.1 Pa·sec, the casting material is liable to be brought into a turbulent flow state due to the reduced viscosity thereof to cause a gas inclusion. On the other hand, if the viscosity $\mu$ is more than 2,000 Pa·sec, the loss in pressure due to the resistance to the deformation of the casting material is increased with the increase in viscosity and for this reason, the casting material is difficult to pass through the gate, causing an unfilled place to be left in the cavity, resulting in a cutout produced in a cast product.

An optimal range of the viscosity $\mu$ of the casting material is represented by 1 Pa·sec$\leqq\mu\leqq$1,000 Pa·sec. The reason is that such a range of viscosity can easily be realized by pressure die-casting apparatus having a conventional casting mold temperature control mechanism. However, if the viscosity $\mu$ is as low as less than 1 Pa·sec, the speed of the casting material during passage through the gate must be controlled accurately to a lower level, and such control is difficult in the conventional pressure die-casting apparatus. On the other hand, if the viscosity $\mu$ is as high as more than 1,000 Pa·sec, the casting material is suddenly reduced in viscosity due to the fact that is cooled by the casting mold, but in order to prevent this, the temperature of the casting mold must be controlled to a high level, and such control is also difficult in the conventional pressure die-casting apparatus.

If the Reynolds number Re of the casting material is set at a value in the above-described range, it is possible to bring the casting material into a laminar flow state, thereby preventing the occurrence of a gas inclusion and the generation of cold shut. However, if the Reynolds number Re is more than 1,500, the casting material is liable to be brought into a turbulent flow state to cause a gas inclusion.

An optimal range of Reynolds number Re is represented by Re$\leqq$100. The reason is that a Reynolds number Re of the casting material in such range can easily be realized by the conventional pressure die-casting apparatus. However, if the Reynolds number Re is more than 100, an influence by an inertia force may be increased depending upon the shapes of the cavity and the gate, so that the smooth charging of the casting material into the cavity cannot be performed, resulting in a fear that a gas inclusion occurs, and cold shuts are produced.

In addition, it is a second object of the present invention to provide a producing process, wherein operational problems can be avoided and the productivity, cast quality and mechanical properties of a cast product can be enhanced by specifying both the speed of a casting material during passage through the gate and the pressurizing force on the casting material filled into the cavity.

To achieve the above object, according to the present invention, there is provided a process for producing an aluminum-based alloy cast product according to claim 1, wherein the speed V of the casting material during passage through the gate is in a range of 0.5 m/sec$\leqq$V$\leqq$20 m/sec, and the pressurizing force P on the casting material into the cavity in the casting mold is in a range of 10 MPa$\leqq$P$\leqq$120 MPa.

If the speed V and the pressurizing force P are set at values in the above ranges, respectively, it is possible to enhance the productivity and cast quality of a cast product and to avoid the operational disadvantage. However, if the speed V is less than 0.5 m/sec, the time taken for charging the casting material into the cavity is prolonged and hence, with lowering of the temperature of the casting material, the viscosity of the casting material is increased, causing an unfilled place to be left in the cavity. If the speed V is more than 20 m/sec, the casting material flows in the form of a jet stream from the gate and is thus charged into the cavity, wherein the casting material is filled in sequence first into an innermost region of the cavity and then into an inlet-side region of the cavity, thereby causing cold shuts and a gas inclusion.

If the pressurizing force P is less than 10 MPa, it is impossible to sufficiently pressurize a casting material having a high viscosity, thereby causing an unfilled place to be left in the cavity. If the pressurizing force P is more than 120 MPa, a large amount of flash is produced on a parting face of the casting mold, and operational disadvantages are arisen, such as an entry of a casting material into between the sleeve and the plunger, and the like, and further, an increase in size of the apparatus is brought about.

It is a third object of the present invention to provide a producing process, wherein the mechanical properties of a cast product can be enhanced, and the control of casting conditions can be facilitated, by specifying the average temperature drop rate.

To achieve the above object, according to the present invention, there is provided a process for producing an aluminum-based alloy cast product according to claim 1 or 2, wherein the casting material is a semi-solidified material prepared by cooling a molten metal of an aluminum hypo-eutectic alloy composition, and in the preparation of the semi-solidified material, the average temperature drop rate R1 of the molten metal is set in a range of 0.1° C./sec≦R1≦10° C./sec.

If the average temperature drop rate R1 for the molten metal is set at a value in the above range, the control of casting conditions can relatively be facilitated to produce a cast product having a good cast quality and excellent mechanical properties. However, if the average temperature drop rate R1 for the molten metal is less than 0.1° C./sec, a long time is required for the preparation and casting of the casting material, resulting in a coalesced structure and in a cutout and the like produced in a cast product. Further, a coalescence of initial crystals α-Al is brought about, and the mechanical properties of a cast product is deteriorated. If the average temperature drop rate R1 for the molten metal is more than 10° C./sec, the time interval for maintaining the required viscosity μ of the molten metal is shortened and hence, the control of the casting conditions become difficult, resulting in a lost utility.

Further, it is a fourth object of the present invention to provide a producing process, wherein a cast quality of a cast product can be enhanced by specifying the area rate of initial crystals α-Al having a shape factor F in a range of F≧0.1 in a solid material.

To achieve the above object, according to the present invention, there is provided a process for producing an aluminum-based alloy cast product by casting, wherein the casting material is a semi-molten material prepared by heating a solid material made of aluminum-based hypo-eutectic alloy, the solid material being one whose area rate Ra of initial crystals α-Al having a shape factor F equal to more than 0.1 is set equal to or more than 80%.

If a sectional area of the initial crystals α-Al is represented by A (a measured value), and a peripheral length of the initial crystals α-Al is represented by L (a measured value), the shape factor F is defined as $F=4\pi A/L^2$ and represents a proportion of the sectional area A of the initial crystals α-Al relative to an area $L^2/4\pi$ of a true circle having a peripheral length L, i.e., a degree of circularity of the initial crystals α-Al. Thus, the shape factor F assumes the maximum value (1.0) in a true circle, and assumes a smaller value, as the sectional shape of the initial crystal α-Al is more flattened and more severely rugged.

If the shape factor F and the area rate Ra of the initial crystals α-Al are specified in the above manner, the viscosity μ of the casting material produced from the solid material during passage through the gate can be matched with the above-described required viscosity, thereby producing a cast product having a good cast quality. However, if the area rate Ra of the initial crystals α-Al whose shape factor F is less than 0.1 is more than 20%, the viscosity μ of the casting material during passage through the gate is higher than the required viscosity μ, resulting in a reduced cast quality of a cast product.

It is a fifth object of the present invention to provide an aluminum-based alloy cast product having a hypo-eutectic alloy composition with excellent elongation, toughness, fatigue strength and the like.

To achieve the above object, according to the present invention, there is provided an aluminum-based alloy cast product which is produced by a producing process, and which has a metallographic structure in which an area rate Ra of initial crystals α-Al having a shape factor F equal to or more than 0.1 is set equal to or more than 80%, and in which the maximum grain size d1 of the initial crystals α-Al is set equal to or less than 300 μm.

The aluminum alloy cast product produced by the above-described producing process has a metallographic structure as described above and exhibits excellent mechanical properties, because a semi-solidified material as a casting material is subjected to a shearing force during passage through the gate, so that the initial crystals α-Al are spheroidized. However, if the area rate Ra of the initial crystals α-Al having a shape factor F equal to or more than 0.1 is lower then 80%, the spheroidization of the initial crystals α-Al is insufficient, resulting in reduced fatigue strength, elongation and toughness of a cast product. If the maximum grain size d of the initial crystals α-Al is more than 300 μm, a resulting cast product also has a reduced fatigue strength.

It is a sixth object of the present invention to provide a producing process, by which a high strength aluminum-based alloy cast product free from defects such as linear cracks can be produced by sufficiently eliminating the directional property of the granular crystalline structure of a primary solid material having an aluminum-based hypo-eutectic alloy composition. To achieve the above object, according to the present invention, there is provided a process for producing an aluminum-based cast product by casting, wherein the casting material is a semi-molten material having solid and liquid phases coexisting therein, and wherein the semi-molten material is produced by; subjecting an ingot to either a hot processing or a cold processing to prepare a primary solid material having a granular crystalline structure with a directional property; subjecting the primary solid material to an annealing treatment to prepare a secondary solid material having a granular crystalline structure with the directional property eliminated; and heating the secondary solid material.

In the step of preparing the primary solid material, the ingot is made in a usual casting process and thus, the metallographic structure of the ingot has coarse grains and dendrites. The hot and cold processings which may be applied include an extrusion, a forging, a rolling and the like. Such processing comminutes the coarse grains and dendrites and hence, it is possible to produce a primary solid material having a granular crystalline structure with a directional property.

In the step of preparing the secondary solid material, conditions for the annealing treatment is varied depending upon the type of the aluminum-based alloy. For example, the processing temperature is in a range of 350° to 500° C., and the processing time is in a range of 2 to 4 hours, followed by a furnace-cooling or an air-cooling. By subjecting the primary solid material to such annealing treatment, a secondary solid material having a granular crystalline structure in which the directional property is eliminated by recrystallization and the like can be produced.

In the step of preparing the semi-molten material, a low frequency induction heating furnace is employed for the purpose of achieving a shortening of the heating time and a soaking effect.

If a casting is carried out using the semi-molten material produced in the above manner, a high strength aluminum-based alloy cast product having a sound and dense metallographic structure can be produced.

Yet further, it is a seventh object of the present invention to provide a producing process, wherein a durability of a casting mold and mechanical properties of an aluminum-based alloy cast product can be enhanced by specifying the maximum grain size d2 of initial crystals in a solid material having an aluminum-based eutectic alloy composition or an aluminum-based hyper-eutectic alloy composition.

To achieve the above object, according to the present invention, there is provided a process for producing an aluminum-based alloy cast product by casting, comprising the steps of: heating a solid material of either an aluminum-based eutectic alloy or an aluminum-based hyper-eutectic alloy to prepare a semi-molten material having solid and liquid phases coexisting therein; and charging the semi-molten material through a gate of a casting mold into a cavity under pressure, wherein the maximum grain size d2 of initial crystals of the solid material is equal to or less than 100 μm.

In a solid material of the above-described type, if the maximum grain size d2 of the initial crystals is set at a value in a range of $d2 \leqq 100$ μm, the wear of the casting mold comprising movable and stationary dies can be suppressed during casting to enhance a durability of the casting mold and mechanical properties of a cast product. However, if the maximum grain size d2 is more than 100 μm, the casting mold is liable to be worn.

An optimal range of the maximum grain size d2 of the initial crystals is represented by $d2 \leqq 50$ μm. If the maximum grain size d2 of the initial crystals is set at a value in such range, it is possible to enhance the machineability and toughness of a cast product, in addition to the avoidance of the wear.

Yet further, it is an eighth object of the present invention to provide a producing process, wherein voids in an aggregate of a quenched and solidified aluminum alloy powder can be decreased to the utmost to improve the soaking degree for the semi-molten material.

To achieve the above object, according to the present invention, there is provided a process for producing an aluminum-based alloy cast product by casting, wherein the solid material is a high density solid material produced by subjecting a quenched and solidified aluminum alloy powder to a forming and solidifying process.

The relative density D of the solid material is set as high as in a range of $70\% \leqq D \leqq 100\%$. If the relative density D of the solid material is set at such a high value, the pore rate is zero or extremely low. Therefore, thermal conductivity in the solid material is improved and thus, heat is conducted uniformly to improve the soaking degree of the semi-molten material and to inhibit the generation of shrinkage voids (or contraction voids) in a caste product to the utmost. This makes it possible to produce a high strength aluminum-based alloy cast product which has excellent mechanical properties as possessed by the quenched and solidified aluminum alloy powder and moreover, has a high freedom degree of shape. However, if the relative density D of the solid material is lower than 70%, the soaking degree of the semi-solidified material is deteriorated, and shrinkage voids are liable to be produced in a cast product.

The above and other objects, features and advantages of the invention will become apparent from a consideration of the following description of the preferred embodiments, taken in conjunction with the accompanying drawings.

DESCRIPTION OF THE PREFERRED EMBODIMENTS

Figure 1:
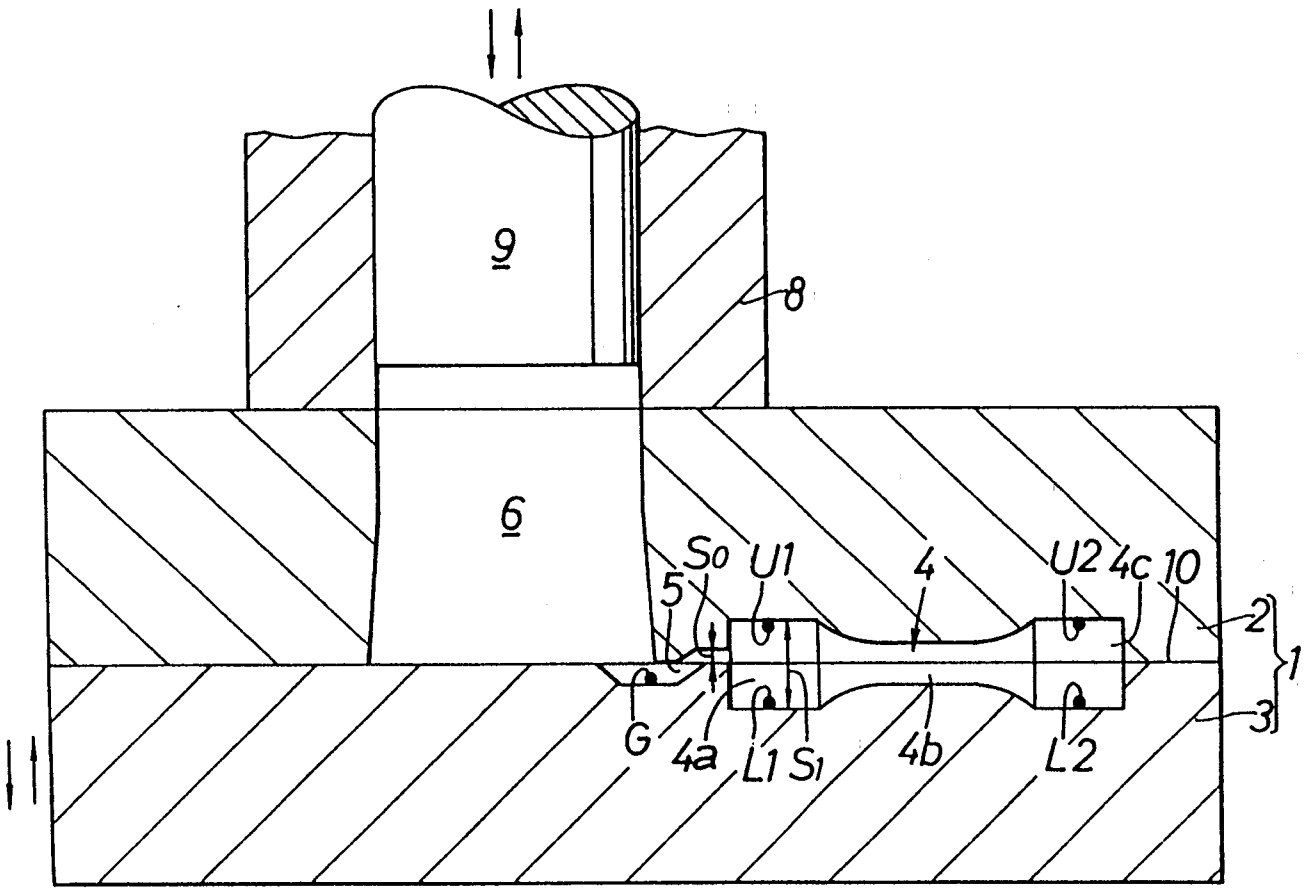
FIG. 1 is a longitudinal sectional view of pressure die-casting apparatus.

FIG. 1 diagrammatically illustrates pressure die-casting apparatus for use in producing an aluminum alloy cast product. A casting mold 1 in the pressure die-casting apparatus comprises a stationary die 2 and a movable die 3 opposed to the stationary die 2. Each of the dies 2 and 3 is made of a hot-die alloy steel (which is a material corresponding to JIS SKD 61). A forming cavity L having a circular section and a gate 5 communicating with one end of the cavity L are defined by both the dies 2 and 3. The gate 5 communicates with a casting material charging hole 6 in the stationary die 2. A sleeve 8 is mounted on the stationary die 2 to communicate with the charging hole 6. A plunger 9 is slidably received in the sleeve 8 such that the plunger 9 may be inserted into and withdrawn from the charging hole 6. The cavity 4 includes an inlet-side region **4*a* of a relatively large volume communicating with the gate 5, an intermediate region 4*b* of a relatively small volume communicating with the region 4*a*, and an innermost region 4c of a relatively large volume communicating with the region 4b**.

In producing an aluminum alloy cast product by casting, following steps (a) to (d) are carried out in sequence.

(a) Preparing a casting material having a solid phase and a liquid phase coexisting therein;

(b) Placing the casting material into the charging hole 6;

(c) Inserting the plunger 9 into the charging hole 6, thereby causing the casting material to be charged successively at a high speed through the gate 5 into the cavity 4 by the plunger 9; and (d) Applying a pressurizing force to the casting material charged into the cavity 4 by maintaining the plunger 9 at an end of its stroke, so that the casting material is solidified under the pressure, thereby providing a cast product.

[I] Production of cast product having composition of aluminum-based hypo-eutectic alloy by casting Aluminum-based hypo-eutectic alloys include Al—Si, Al—Mg, Al—Cu, Al—Ca and Al—Ga based hypo-eutectic alloys and the like.

For example, an alloy having a Si content of less than 11.7% by weight may be used as the Al—Si based hypo-eutectic alloy. For example, this Al—Si based hypo-eutectic alloy has a composition comprising 6.5% (inclusive) to 7.5% (inclusive) by weight of Si, at most 0.20% by weight of Fe, at most 0.20% by weight of Cu, at most 0.10% by weight of Mn, 0.40% (inclusive) to 0.70% (inclusive) by weight of Mg, and 0.04% (inclusive) to 0.20% (inclusive) by weight of Ti.

Among the above-described chemical constituents, Si contributes to an increase in strength of a resulting cast product by precipitation of $Mg_2Si$ by a thermal treatment. However, if the Si content is less than 6.5% by weight, the strength increasing effect is reduced. On the contrary, if the Si content is more than 7.5% by weight, an impact value and a toughness of the cast product are reduced.

Fe contributes to an increase in high-temperature strength of a cast product and a prevention of the seizure of the casting material to the casting mold, particularly to the dies. Such high-temperature strength increasing mechanism is brought about by the buildup of dispersion of an AlFeMn intermetallic compound. However, if the Fe content is more than 0.20% by weight, a cast product having a reduced elongation and a reduced toughness is produced.

Cu contributes to an increase in strength of a resulting cast product by precipitation of $Al_2Cu$ by a thermal treatment. However, if the Cu content is more than 0.20% by weight, a corrosion resistance of the cast product is reduced.

Mn contributes to an increase in high-temperature strength of a cast product and has a function of rendering the AlFe intermetallic compound massive. However, if the Mn content is more than 0.10% by weight, a cast product having a reduced elongation and a reduced toughness is produced.

Mg contributes to an increase in strength of a resulting cast product by cooperation with Si, as described above. However, if the Mg content is less than 0.20% by weight, the strength increasing effect is smaller. On the other hand, if Mg>0.70% by weight, a cast product having a reduced elongation and a reduced toughness is produced.

Ti contributes to a reduction in size of crystal grains at the above-described content thereof.

(1) In the case where a semi-solidified material derived from a molten metal is used as a casting material For cooling conditions for preparing the semi-solidified material from the molten metal, the average temperature dropping rate $R_1$ for the molten metal is set in a range of $0.1°\ C./sec \leqq R_1 \leqq 10°\ C./sec$, and the viscosity $\mu$ of the semi-solidified material is set in a range of $0.1\ Pa{\cdot}sec \leqq \mu \leqq 2{,}000\ Pa{\cdot}sec$. If the cooling conditions are manner, the control of the casting conditions can be relatively facilitated to produce a cast product having a good cast quality and excellent mechanical properties. The viscosity $\mu$ of the semi-solidified material is set at the same value as that during casting. If the viscosity $\mu$ is less than 0.1 Pa·sec, the handleability of the semi-solidified material is degraded. On the other hand, if the viscosity $\mu$ is more than 2,000 Pa·sec, a cast product having a deteriorated cast quality is produced.

The nature of the semi-solidified material during passing through the gate 5 in a casting operation, i.e., the viscosity $\mu$ of the semi-solidified material is set in a range of $0.1\ Pa{\cdot}sec \leqq \mu \leqq 2{,}000\ Pa{\cdot}sec$, as described above, and Reynolds number Re is set in a range of $Re \leqq 1{,}500$, as described above.

In order to produce a cast product having an enhanced cast quality, the Reynolds number Re of the semi-solidified material and the sectional area increase rate Rs in the casting mold 1 become important factors. Here, the sectional area increase rate Rs is represented by the expression, $Rs = S1/S0$, wherein S0 represents the sectional area of the gate 5, and the S1 represents the sectional area of the inlet-side region 4a of the cavity 4 (FIG. 1).

The sectional area increase rate Rs is set in a range of $Rs \leqq 10$. By this, it is possible to prevent a gas inclusion by the semi-solidified material and cold shuts from being generated. However, if the sectional area increase rate Rs is larger than 10, the semi-solidified material flows in the form of a jet stream from the gate 5 into the cavity 4, wherein the innermost region 4c is first filled and then, the inlet-side region 4a is filled with the semi-solidified material. For this reason, the cold shuts may be generated.

An optimal range for the sectional area increase rate Rs is represented by $1 \leqq Rs \leqq 5$. This is because a sectional area increase rate Rs in such a range can easily be realized by a conventional pressure die-casting apparatus. However, if the sectional area increase rate Rs is larger than 5, the sectional area of the gate 5 is substantially reduced and for this reason, the solidification of the semi-solidified material in the gate 5 proceeds ahead of the final solidification of the semi-solidified material in the cavity 4 and as a result, it is failed to provide a feeding head effect, thereby bringing about a fear that a shrinkage may be generated in thick wall portions of a cast product corresponding to the inlet-side region 4a and the innermost region 4c. On the other hand, if the sectional area increase rate Rs is smaller than 1, the sectional area of the gate 5 is substantially equal to that of the inlet-side region 4a of the cavity 4, resulting in an operational problem that the yield of a cast product is decreased with increasing of a scrap portion corresponding to the gate 5.

The speed V of the semi-solidified material during passage through the gate 5 is set in a range of $0.5\ m/sec \leqq V \leqq 20\ m/sec$, as described above, and the pressurizing force P on the semi-solidified material filled in the cavity 4 is set in a range of 10 MPa≦P≦120 MPa, as described above.

An aluminum-based alloy cast product produced under conditions as described above has a metallographic structure in which an area rate Ra of an initial crystal α-Al having a shape factor F in a range of F≧0.1 is set in a range of Ra≦80% and in which a maximum grain size d1 of the initial crystal α-Al is set in a range of d1≦300 μm. Such cast product has excellent elongation, toughness and fatigue strength and the like. One element selected from the group consisting of Sr, Sb and Na may be added to the molten metal of the Al—Si based hypo-eutectic alloy composition for the purpose of spheroidizing the initial crystal.

Particular examples will be described below.

A molten metal of an Al—Si based hypo-eutectic alloy having a composition given in Table 1 was prepared using a controlled furnace having heating and cooling mechanisms.

TABLE 1

| Chemical Constituents (% by weight) | | | | | | | |
|---|---|---|---|---|---|---|---|
| Si | Fe | Cu | Mn | Mg | Zn | Ti | Al |
| 7.1 | 0.10 | 0.04 | 0.01 | 0.46 | 0.09 | 0.12 | balance |

In the casting mold 1, the sectional area increase rate Rs (S1/S0) established between the sectional area S0 of the gate 5 and the sectional area S1 of the inlet-side region 4*a* of the cavity 4 was set at 4 (Rs=4).

First, the molten metal was cooled in the controlled furnace with an average temperature drop rate R1 set at 1° C./sec, thereby preparing a semi-solidified material having a volume fraction Vf of 70%.

The semi-solidified material was placed into the charging hole 6 of the casting mold and then, charged successively at a high speed through the gate 5 into the cavity 4 by the plunger 9. In this case, the speed of movement of the plunger 9 was set at about 78 mm/sec; the speed V of the semi-solidified material during passage through the gate 5 was 3 m/sec; the viscosity μ was 300 Pa·sec; and the Reynolds number Re was 0.21.

The behavior of semi-solidified material charged was examined by measuring a start point of rising of the temperature at a lower place G of the gate 5 in the casting mold 1, upper and lower places U1 and L1 of the inlet-side region 4*a* of the cavity 4 and upper and lower places U2 and L2 of the innermost region 4*c* of the cavity 4, as shown in FIG. 1. The result showed that the sequence of the places filled with the semi-solidified material was G→L1→U1→L2 (U2 was substantially simultaneous with L2), which was ideal for avoiding the generation of cast defects.

The plunger 9 was maintained at an end of its stroke, thereby applying a pressurizing force to the semi-solidified material filled in the cavity 4 to solidify the semi-solidified material under the pressure, thus providing a cast product A1. In this case, it was confirmed that the pressurizing force P on the semi-solidified material was of 30 MPa and a flash produced on the parting face 10 of the casting mold 1 was of an extremely small amount.

Figure 2:
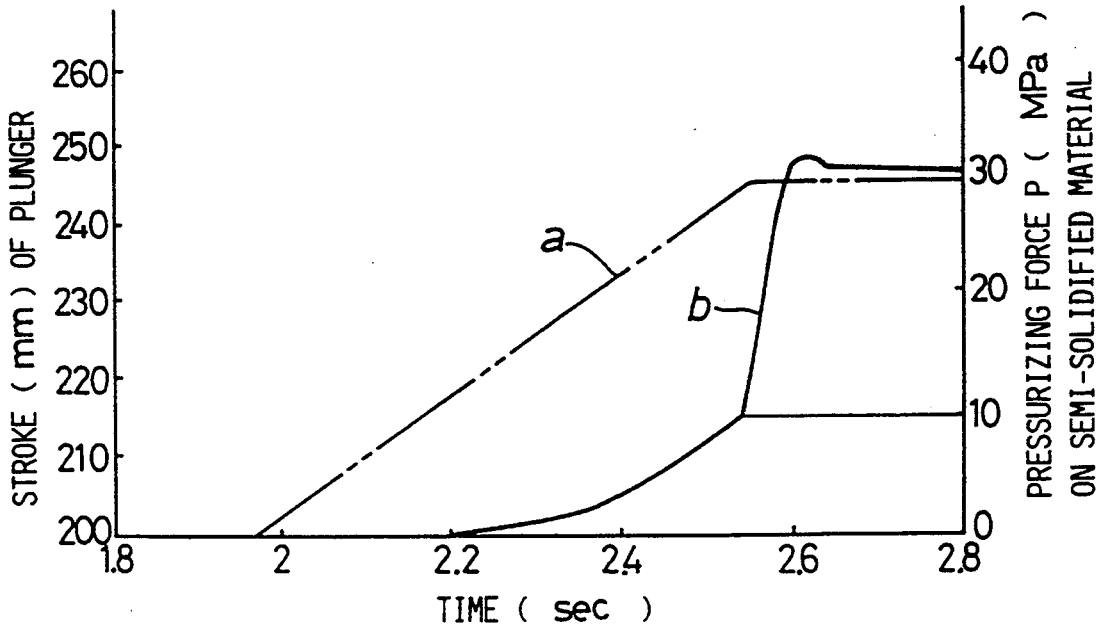
FIG. 2 is a graph illustrating the relationship between the time and the stroke of a plunger as well as the pressurizing force on a semi-solidified material.

FIG. 2 illustrates the relationship between the time required for the above-described casting operation and the stroke of the plunger as well as the pressurizing force on the semi-solidified material. In FIG. 2, a line a represents the stroke, and a line b represents the pressurizing force. It can be seen from FIG. 2 that the pressurizing force on the semi-solidified material is suddenly increased in the vicinity of the end of the stroke of the plunger 9. The pressurizing force at the start of this increasing is 10 MPa, which is a minimum pressurizing force for producing a cast product A1.

Figure 3:
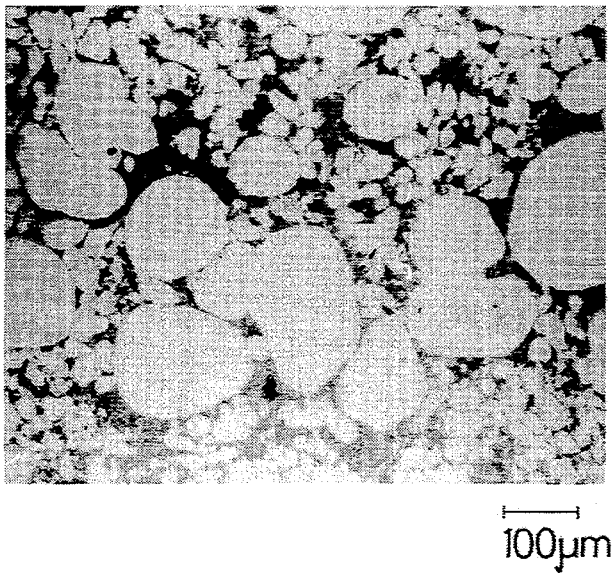
FIG. 3 is a photomicrograph showing a first example of a metallographic structure of a cast product.

FIG. 3 is a photomicrograph (100 magnifications) showing the metallographic structure of the cast product A1 produced by the above-described casting process. In FIG. 3, each of light gray granular portions occupying most of the entire region is an initial crystal α-Al. It can be seen that the maximum grain size d of the initial crystals is of 300 μm. The cast product Al having such fine initial crystals α-Al has an excellent fatigue strength. Such a metallographic structure is produced by subjecting the semi-solidified material to a shearing force during passing through the gate 5 and by solidifying the material under pressure. The area rate Ra of the initial crystals α-Al having the shape factor F equal to or more than 0.1 is 98%. By setting of the area rate Ra at such a value, it is possible to increase the fatigue strength, elongation and toughness of the cast product A1. Further, as apparent from FIG. 3, any cold shuts and any pores due to a gas inclusion were not produced in the cast product. Further, any cutouts due to unfilling of the semi-solidified material into the cavity 4 were not produced in the cast product. Therefore, the cast product was proved to have an excellent cast quality.

Then, cast products A2 and A3 as examples of the present invention and cast products B1 and B2 as comparative examples were produced in the same casting process as described above, except that the speed V and the Reynolds number Re of the semi-solidified material during passage through the gate 5 were varied by changing the speed of the movement of the plunger 9.

Table 2 shows the relationship between the speed V and the Reynolds number Re for the cast products A1, A2 and A3 as examples of the present invention and cast products B1 and B2 as comparative examples.

TABLE 2

| | Semi-solidified material | |
|---|---|---|
| Cast product | Speed V (m/sec) | Reynolds Number Re |
| A1 | 3 | 0.21 |
| A2 | 0.7 | 0.05 |
| A3 | 10 | 0.71 |
| B1 | 0.3 | 0.02 |
| B2 | 30 | 2.1 |

Figure 4:
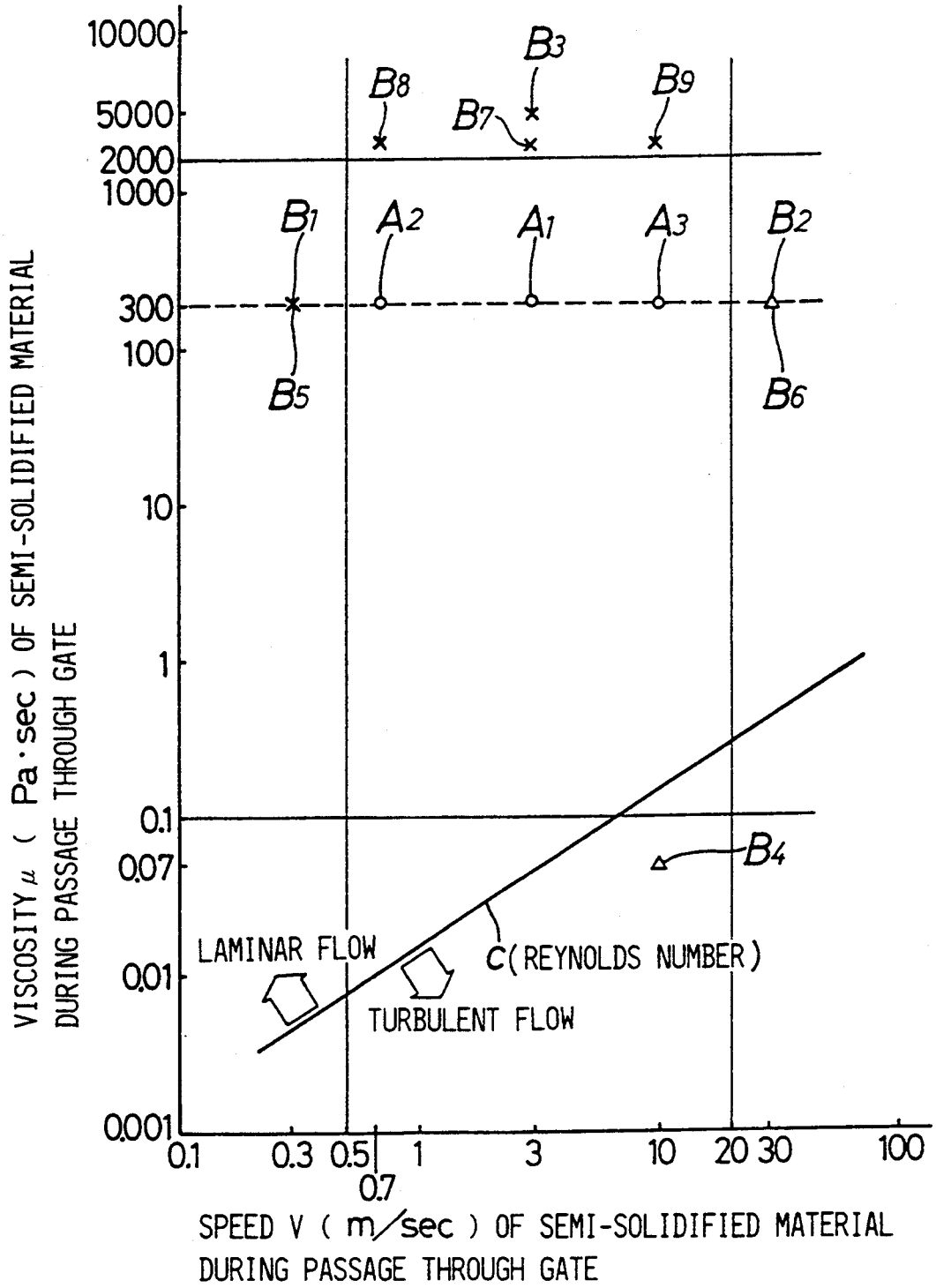
FIG. 4 is a graph illustrating the relationship between the speed and viscosity of the semi-solidified material during passage through a gate.

FIG. 4 shows the relationship between the speed V of and the viscosity μ of the semi-solidified material during passage through the gate 5. In FIG. 4, a line c corresponds the case where the Reynolds number of the semi-solidified material during passage through the gate 5 is 1,500. Therefore, a region above the line c is a laminar flow, and a region below the line c is a turbulent flow region.

Figure 5:
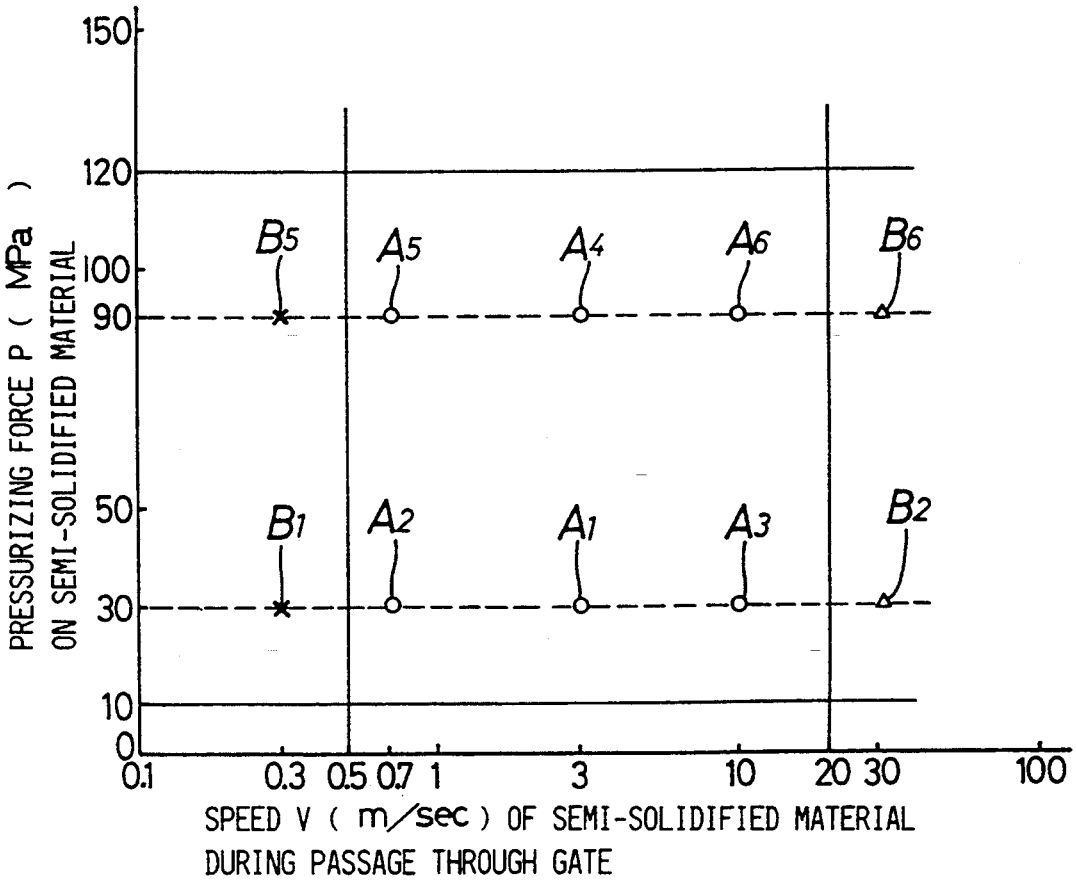
FIG. 5 is a graph illustrating the relationship between the speed of the semi-solidified material during passage through the gate and the pressurizing force on the semi-solidified material.

FIG. 5 shows the relationship between the speed V of the semi-solidified material during passage through the gate 5 and the pressurizing force P on the semi-solidified material filled in the cavity 4.

From the viewpoint of an increase in cast quality, as described above, it is preferable that the speed V is in a range of 0.5 m/sec≦V≦20 m/sec; the viscosity μ is in a range of 0.1 Pa·sec≦μ≦2,000 Pa·sec; the Reynolds number Re is in a range of Re≦1,500, and the pressurizing force P is in a range of 10 MPa≦P≦120 MPa. It can be seen from Table 2 and FIGS. 4 and 5 that the above-described conditions are satisfied for the cast products A1, A2 and A3 as the examples of the present invention.

However, for the cast product B1 as the comparative example, the speed V is less than the lower limit value (0.5 m/sec). For this reason, the sequence of charging of the semi-solidified material into the cavity 4 was G→L1→U1→L2→U2. As a result, a portion unfilled with the semi-solidified material was left in the upper place U2 in the innermost region 4c of the cavity 4, and correspondingly, a cutout was produced in the cast product B1. In the cast product B2 as the comparative example, the speed V is more than the upper limit value (20 m/sec). For this reason, the sequence of charging of the semi-solidified material into the cavity 4 was G→U2→L2→L1→U1. As a result, the semi-solidified material was early partially solidified in the inlet-side region 4a and the innermost region 4c of the cavity 4, and correspondingly, cold shuts were produced in the cast product B2. In addition, it was confirmed that pores were produced in the cast product B2 due to the gas inclusion, because the semi-solidified material was allowed to flow in a jet stream into the cavity 4.

For comparison, cast products B3 and B4 were produced in the same casting process, except that only the conditions in Table 3 were changed. Both the cast products B3 and B4 are also shown in FIG. 4.

TABLE 3

| Cast product | Semi-solidified material: Speed V (m/sec) | Viscosity μ (Pa · sec) | Reynolds number Re |
|---|---|---|---|
| B3 | 3 | 5,000 | 0.01 |
| B4 | 10 | 0.07 | 3,000 |

In the cast product B3 as the comparative example, it was observed that cutouts were produced due to the increased viscosity of the semi-solidified material. In the cast product B4 as the comparative example, it was observed that the gas inclusion occurred by the turbulent flow due to the decreased viscosity of the semi-solidified material, and thus, pores were produced in the cast product B4.

For comparison, cast products A4, A5 and A6 corresponding to those A1, A2 and A3 as the examples of the present invention as well as cast products B5 and B6 corresponding to those B1 and B2 as the comparative examples were produced in the same casting process under the same conditions as those described above, except that the pressurizing force P was set at 90 MPa. It was confirmed that these cast products A4, A5, A6, B5 and B6 had cast qualities shown in FIGS. 4 and 5 and corresponding to those of the cast products Al, A2, A3, B1 and B2, respectively. More specifically, it was observed that no cast defects were produced in any of the cast products A4, A5 and A6, whereas cutouts were produced in the cast product B5, and cold shuts and pores were produced in the cast product B6.

Table 4 shows various conditions in casting cast products B7, B8 and B9 as comparative examples, and the type of cast defects in the cast products B7, B8 and B9. In these conditions, only the average temperature drop rate R1 of a molten metal and the viscosity μ of a semi-solidified material depart from the above-described range.

TABLE 4

| Cast product | M.M. A.R. R1 (°C./sec) | Semi-solidified material: Speed V (m/sec) | Viscosity μ (Pa · sec) | Reynolds number Re | Pr.Fo. (MPa) | Type of cast defects |
|---|---|---|---|---|---|---|
| B7 | 0.01 | 3 | 3,000 | 0.021 | 90 | Cutouts |
| B8 | 0.01 | 0.7 | 3,000 | 0.005 | 90 | Cutouts |
| B9 | 0.01 | 10 | 3,000 | 0.071 | 90 | Cutouts |

M.M. = Molten metal
A.R. R1 = Average temperature drop rate R1
Pr.Fo. = Pressurizing force Table 5 shows the relationship between the area rate Ra of initial crystals α-Al having a shape factor F equal to or more than 0.1 and the fatigue strength for the cast product A1 as the example (FIG. 3) and cast products B10 and B11 as comparative examples. The cast products B10 and B11 have the same composition of the cast product A1, but the cast product B10 was produced in a gravity die-casting process, and the cast product B11 was produced in a molten metal casting process. Each of initial crystals α-Al in the cast products B10 and B11 is substantially dendrite-shaped. In Table 5, the stress amplitude δ a represents a value at the $10^8$ times of repeated breakings. A fracture probability 0.5 means that five of ten test pieces are fractured, and a fracture probability 0.1 means that one of ten test pieces is fractured.

TABLE 5

| Cast product | Area rate Ra (%) | Stress amplitude σ a (MPa): Fracture probablity 0.5 | Fracture probabilty 0.1 |
|---|---|---|---|
| A1 | 98 | 113.5 | 102.2 |
| B10 | 30 | 73.8 | 57.5 |
| B11 | 35 | 75.4 | 71.5 |

Area rate Ra = Area rate Ra of initial crystals α-Al having a shape factor F equal to or more than 0.1

Area rate Ra=Area rate Ra of initial crystals α-Al having a shape factor F equal to or more than 0.1

As is apparent from Table 5 that the cast product A1 as the example of the present invention has an excellent fatigue strength, as compared with the cast products B10 and B11 as the comparative examples.

Table 6 shows the relationship between the area rate Ra of the initial crystals α-Al having the shape factor F equal to or more than 0.1 and other mechanical properties for the cast product A1 (FIG. 3) and the cast products B10 and B11.

TABLE 6

| | Cast Product: A1 | B10 | B11 |
|---|---|---|---|
| Area rate Ra (%) of initial crystals α-Al having the shape factor F equal to or more than 0.1 | 98 | 30 | 35 |
| 0.2% proof strength σ0.2 (MPa) | 247 | 241 | 249 |
| Tensile strength σB (MPa) | 299 | 282 | 293 |
| Elongation δ (%) | 7.0 | 3.7 | 4.6 |
| Charpy impact value (J/cm$^2$) | 4.5 | 2.6 | 3.6 |

It is apparent from Table 6 that the cast product A1 as the example of the present invention has excellent elongation and toughness, as compared with the cast products B10 and B11 as the comparative examples.

(2) In the case where a semi-molten material derived from a solid material is used as a casting material In the metallographic structure of the solid material, the area rate Ra of initial crystals α-Al having a shape factor F equal to or more than 0.1 is set at a value equal to or more than 80%, as described above, and the maximum grain size d of the initial crystals α-Al is set at a value equal to or less than 300 μm. If the maximum grain size d of the initial crystals α-Al is set at such a value, it is possible to increase the fatigue strength of a cast product. However, if the maximum grain size d exceeds 300 μm, such effect cannot be obtained.

When a semi-molten material is produced from the solid material, heating conditions therefor are set in the following manner:

The average temperature rise rate R2 of the solid material is equal to or more than 0.2° C./sec (i.e., R2≦0.2° C./sec ); the soaking degree Δ T between the inner and outer portions of the semi-molten material is equal to or less than ±10° C.(i.e., ΔT≦±10° C.), and the viscosity μ of the semi-molten material is in a range of 0.1 Pa·sec≦μ≦2,000 Pa·sec. If the heating conditions are set in this manner, it is possible to efficiently conduct the preparation and handling of the semi-molten material and to increase the cast quality of the cast product. However, if the average temperature rise rate R2 is less than 0.2° C./sec, time required for preparation of the semi-molten material becomes long, thereby bringing about coalescence of initial crystals α-Al, resulting in injured mechanical properties of a cast product. An optimal range of the average temperature rise rate R2 is represented by R2≧1.0° C./sec. The reason is that an average temperature rise rate R2 less than 1.0° C./sec is liable to bring about a reduction in productivity, a coalescence of metallographic structure, a surface oxidation and the like.

If the soaking degree ΔT between the inner and outer portions of the semi-molten material is more than ±10° C., the viscosity μ is partially varied in the semi-molten material, thereby causing a meltdown portion to be created, and causing a unfilled place to be left in the cavity 4, thus bringing about a cutout produced in a cast product. An optimal range of the soaking degree ΔT is represented by ΔT≦±3° C. The reason is that the semi-molten material can be automatically handled in such a range, thereby enhancing the productivity of a cast product.

The viscosity μ of the semi-molten material is set at the same range as that during casting. If the viscosity μ is less than 0.1 Pa·sec, a melt-down portion is created, resulting in a deteriorated handleability of the semi-molten material. On the other hand, a viscosity μ more than 2,000 Pa·sec will result in a reduced cast quality of a cast product, as described above.

The nature of the semi-molten material during passage through the gate 5 in a casting operation, i.e., the viscosity μ of the semi-molten material is set in a range of 0.1 Pa·sec≦μ≦2,000 Pa·sec, and the Reynolds number Re is set in a range of Re≦1,500, as described above. The sectional area increase rate Rs in the casting mold 1 is set in a range of Rs≦10. Further, the speed V of the semi-molten material during passage through the gate 5 is set in a range of 0. 5 m/sec≦V≦20 m/sec, and the pressurizing force P on the semi-molten material filled in the cavity 4 is set in a range of 10 MPa≦P≦120 MPa, as described above.

A particular example will be described below. In this example, pressure die-casting apparatus was used.

As a solid material of an Al—Si based hypo-eutectic alloy, a material having a composition similar to that shown in the above-given Table 1 was selected. In the metallographic structure of this material, the area rate Ra of initial crystals α-Al having a shape factor F in a range of F≧0.1 was 80%, and the maximum grain size d of the initial crystals α-Al was 200 μm.

First, the solid material was placed into a heating furnace, and then heated with an average temperature rise rate R2 set at a value of 1. 3° C./sec, thereby preparing a semi-molten material having a soaking degree ΔT equal to 6° C. between the inner and outer portions and a solid phase volume fraction Vf equal to 70%. The solid phase had a metallographic structure similar to that of the solid material.

The semi-molten material was placed into the charging hole 6 in the casting mold 1 and then charged at a high speed sequentially through the gate 5 into the cavity 4 by means of the plunger 9. In this case, the speed of movement of the plunger 9 was set at about 78 mm/sec; the speed V of the semi-molten material during passage through the gate 5 was 3 m/sec; the viscosity μ was 300 Pa·sec, and the Reynolds number Re was 0.21.

The behavior of semi-molten material charged was examined by measuring the start point of rising of the temperature at the lower place G of the gate 5 in the casting mold 1, the upper and lower places U1 and L1 of the inlet-side region 4*a* and the upper and lower places U2 and L2 of the innermost region 4*c* the cavity 4. The result showed that the sequence of the places filled with the semi-molten material was G→L1→U1→L2 (U2 was substantially simultaneous with L2), which was ideal for avoiding the generation of cast defects.

The plunger 9 was maintained at the end of its stroke to apply a pressurizing force to the semi-molten material filled in the cavity 4, thereby solidifying the semi-molten material under the pressure to provide a cast product A7. In this case, it was confirmed that the pressurizing force P on the semi-molten material was 30 MPa, and flashes produced on a parting face 10 of the casting mold 1 were extremely few. The relationship among the time required for the above-described casting operation; the stroke of the plunger; and the pressurizing force on the semi-molten material is the same as shown in FIG. 2.

Figure 6:
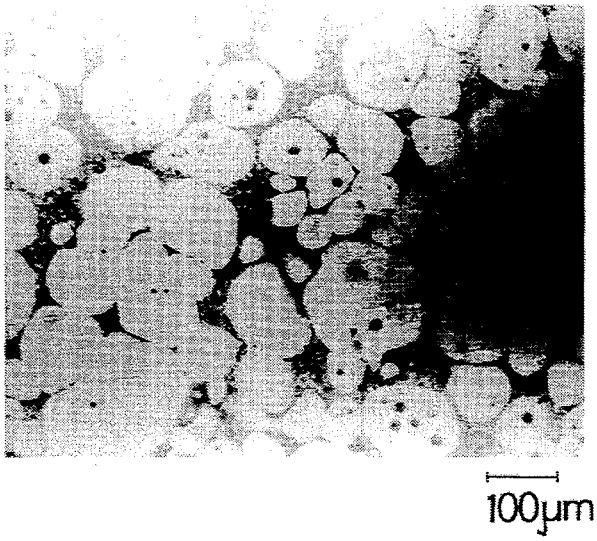
FIG. 6 is a photomicrograph showing a second example of a metallographic structure of a cast product.

FIG. 6 is a photomicrograph (100 magnifications) showing the metallographic structure of the cast product A7 produced by the above-described casting process. In FIG. 6, each of light gray granular portions occupying most of the entire region is an initial crystal α-Al. It can be seen that the maximum grain size d of the initial crystals is of 200 μm. The reason why such a metallographic structure is formed is that the maximum grain size d of the initial crystals α-Al in solid phases in the semi-molten material is of 200 μm, and the reduction in size of the initial crystals precipitated from liquid phases is achieved, because the liquid phases are subjected to a shearing force during passage through the gate 5 and solidified under the pressure. The area rate Ra of the initial crystals α-Al having a shape factor F in a range of F≧0.1 is 98%. By setting the area rate Ra of the initial crystals α-Al at such a value, it is possible to provide a cast product A7 having increased elongation and toughness. Further, as apparent from FIG. 6, any cold shuts and any pores due to a gas inclusion were not produced in the cast product. Further, any cutouts due to unfilling of the semi-molten material into the cavity 4 were not produced in the cast product. Therefore, It was ascertained that the cast product had an excellent cast quality.

Then, cast products A8 and A9 as examples of the present invention and cast products B12 and B13 as comparative examples were produced in the same casting process as described above, except that the speed V of the semi-molten material during passage through the gate 5 and the Reynolds number Re were altered by changing the speed of the movement of the plunger 9.

Table 7 shows the relationship between the speed V and the Reynolds number Re for the cast products A7, A8 and A9 as examples of the present invention and the cast products B12 and B13 as comparative examples.

TABLE 7

| Cast product | Semi-molten material Speed V (m/sec) | Reynolds Number Re |
|---|---|---|
| A7 | 3 | 0.21 |
| A8 | 0.7 | 0.05 |
| A9 | 10 | 0.71 |
| B12 | 0.3 | 0.02 |
| B13 | 30 | 2.1 |

Figure 7:
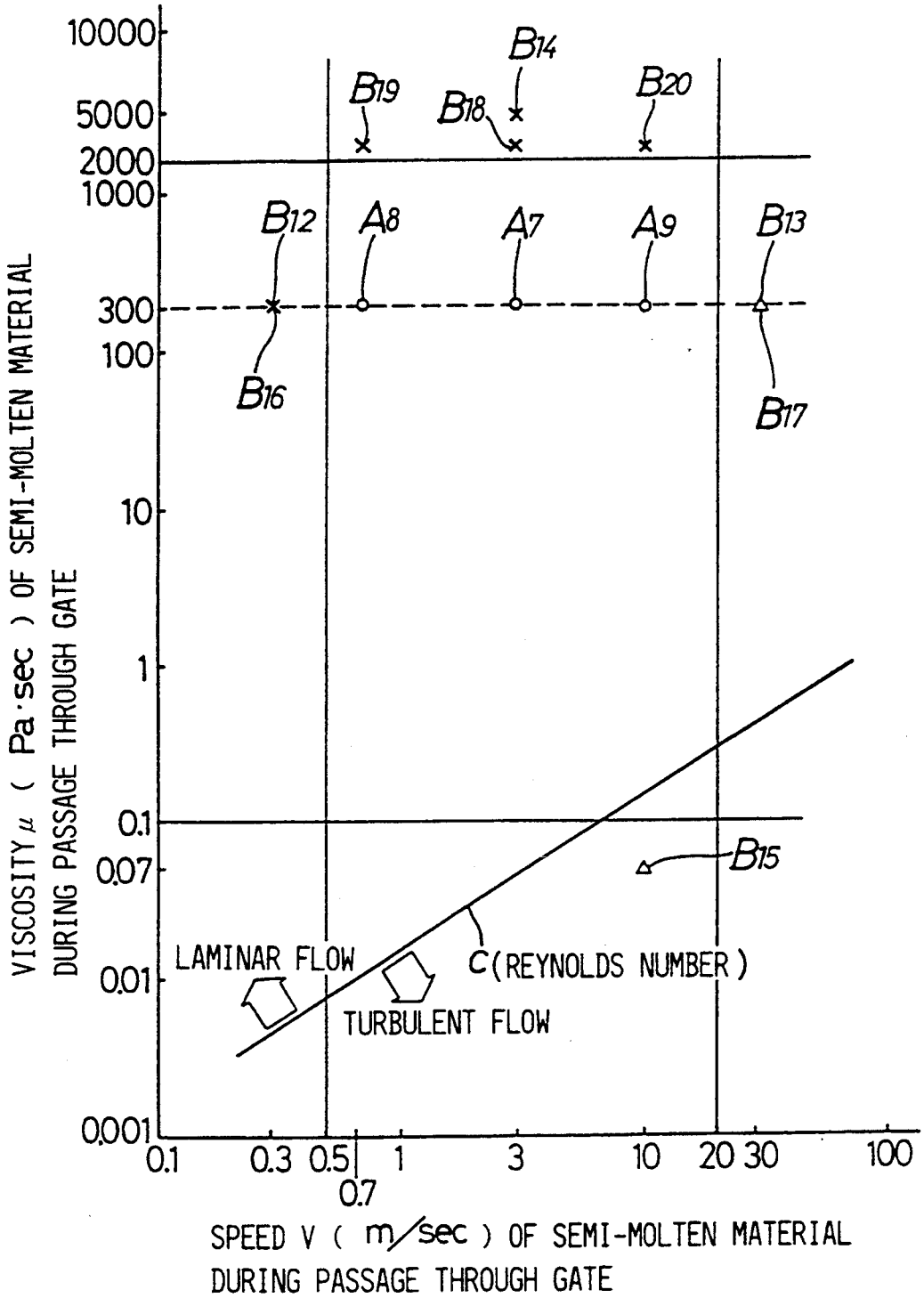
FIG. 7 is a graph illustrating the relationship between the speed and viscosity of a semi-molten material during passage through the gate.

FIG. 7 shows the relationship between the speed V of and the viscosity $\mu$ of the semi-molten material during passage through the gate 5. In FIG. 7, a line c corresponds the case where the Reynolds number Re of the semi-molten material during passage through the gate 5 is 1,500. Therefore, a region including the line c and above the line c is a laminar flow, and a region below the line c is a turbulent flow region.

Figure 8:
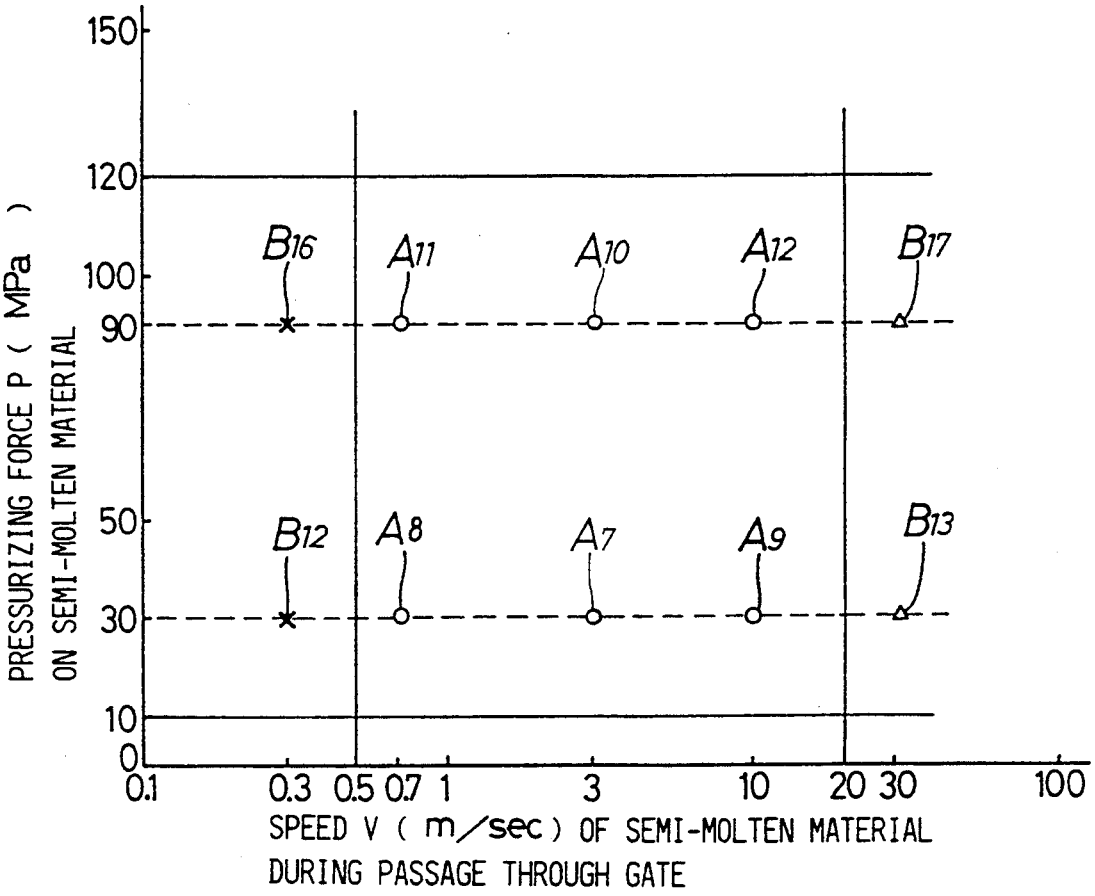
FIG. 8 is a graph illustrating the relationship between the speed of the semi-molten material during passage through the gate and the pressurizing force on the semi-molten material.

FIG. 8 shows the relationship between the speed V of the semi-molten material during passage through the gate 5 and the pressurizing force P on the semi-molten material filled in the cavity 4.

From the viewpoint of an increase in cast quality, as described above, it is preferable that the speed V is in a range of 0.5 m/sec$\leqq$V$\leqq$20 m/sec; the viscosity $\mu$ is in a range of 0.1 Pa·sec$\leqq\mu\leqq$2,000 Pa·sec; the Reynolds number Re is in a range of Re$\leqq$1,500; and the pressurizing force P is in a range of 10 MPa$\leqq$P$\leqq$120 MPa. It can be seen from Table 7 and FIGS. 7 and 8 that the above-described conditions are satisfied for the cast products A7, A8 and A9 as the examples of the present invention.

However, in the cast product B12 as the comparative example, the speed V is less than the lower limit value (0.5 m/sec). For this reason, the sequence of charging of the semi-molten material into the cavity 4 was G→L1→U1→L2→U2 in FIG. 1. As a result, a portion unfilled with the semi-molten material was left in the upper place U2 in the innermost region 4c of the cavity 4, and correspondingly, a cutout was produced in the cast product B12. In the cast product B13 as the comparative example, the speed V exceeds the upper limit value (20 m/sec). For this reason, the sequence of charging of the semi-molten material into the cavity 4 was G→U2→L2→L1→U1 in FIG. 1. As a result, the semi-molten material was partially solidified early in the inlet-side region 4a and the innermost region 4c of the cavity 4, and correspondingly, cold shuts were produced in the cast product B13. In addition, it was observed that pores were produced in the cast product B13 due to the gas inclusion, because the semi-molten material was allowed to flow in a jet stream into the cavity 4.

For comparison, cast products B14 and B15 were produced in the same casting process, except that only the conditions in Table 8 were changed. Both the cast products B14 and B15 are also shown in FIG. 7.

TABLE 8

| Cast product | Semi-molten material Speed V (m/sec) | Viscosity $\mu$ (Pa · sec) | Reynolds number Re |
|---|---|---|---|
| B14 | 3 | 5,000 | 0.01 |
| B15 | 10 | 0.07 | 3,000 |

In the cast product B14 as the comparative example, it was observed that cutouts were produced due to the increased viscosity of the semi-molten material. In the cast product B15 as the comparative example, it was observed that the gas inclusion occurred by the turbulent flow due to the decreased viscosity of the semi-molten material, and thus, pores were produced in the cast product B4.

For comparison, cast products A10, A11 and A12 corresponding to those A7, A8 and A9 as the examples of the present invention as well as cast products B16 and B17 corresponding to those B12 and B13 as the comparative examples were produced in the same casting process under the same conditions as those described above, except that the pressurizing force P was set at 90 MPa. It was confirmed that these cast products A10, A11, A12, B16 and B17 had cast qualities shown in FIGS. 7 and 8 and corresponding to those of the cast products A7, A8, A9, B12 and B13, respectively. More specifically, it was observed that no cast defects were generated in any of the cast products A10, A11 and A12, whereas cutouts were generated in the cast product B16, and cold shuts and pores were produced in the cast product B17.

Table 9 shows various conditions for producing the cast products B18, B19 and B20 as comparative examples, and the type of cast defects in the cast products B18, B19 and B20. In these conditions, the area rate Ra of initial crystals $\alpha$-Al, with a shape factor F equal to or more than 0.1, of a solid material and the viscosity $\mu$ of a semi-molten material are out of the respective ranges defined in the present invention.

TABLE 9

| Cast product | S.M. A.R. Ra (°C./sec) | Semi-molten material Speed V (m/sec) | Viscosity (Pa · sec) | Reynolds number R | Pr.Fo. (MPa | Type of cast defects |
|---|---|---|---|---|---|---|
| B18 | 30 | 3 | 3,000 | 0.02 | 90 | Cutouts |
| B19 | 30 | 0.7 | 3,000 | 0.005 | 90 | Cutouts |
| B20 | 30 | 10 | 3,000 | 0.07 | 90 | Cutouts |

S.M. = Solid material
A.R. Ra = area rate Ra of the initial crystals $\alpha$-Al having a shape factor F equal to or more than 0.1
Pr.Fo. = Pressurizing force (3) In the case where other semi-molten material obtained from a solid material is used as a casting material The semi-molten material is produced by subjecting an ingot to either one of a hot processing and a cold processing to prepare a primary solid material having a granular crystalline structure with a directional property; subjecting the primary solid material to an annealing treatment to prepare a secondary solid material having a granular crystalline structure with the directional property eliminated; and then heating the secondary solid material.

In the step of preparing the primary solid material, the ingot is produced by a usual casting process and hence, the metallographic structure of the ingot includes coarse grains and dendrites.

The hot and cold processings which may be used include an extrusion, a forging, a rolling and the like. Such processing causes the comminution of the coarse grains and dendrites to be achieved, thereby providing the primary solid material having the granular crystalline structure with the directional property.

In the step of preparing the secondary solid material, conditions for the annealing treatment depend upon the type of the aluminum-based alloy. For example, the treatment temperature is in a range of 350° to 500° C., and the treatment time is in a range of 2 to 4 hours, which is followed by a furnace-cooling or an air-cooling. By subjecting the primary solid material to such an annealing treatment, the secondary solid material is produced which has the granular crystalline structure with the directional property eliminated by the recrystallization.

In the step of producing the semi-molten material, a low frequency induction heating furnace is used for the purpose of achieving a shortening in heating time and a soaking effect.

In carrying out pressure die-casting process using the semi-molten material, an apparatus similar to that shown in FIG. 1 is used.

For example, an Al—Si base alloy is used as the aluminum-based alloy and has a composition which is as follows:

0.1% by weight $\leqq$ Si $\leqq$ 0.25% by weight,
0.9% by weight $\leqq$ Fe $\leqq$ 1.3% by weight,
1.9% by weight $\leqq$ Cu $\leqq$ 2.7% by weight,
1.3% by weight $\leqq$ Mg $\leqq$ 1.8% by weight,
0.9% by weight $\leqq$ Ni $\leqq$ 1.2% by weight, and
balance = aluminum Among the above chemical constituents, Si improves strength and wear resistance of a cast product. However, if the Si content is less than 0.1% by weight, such improving effects are reduced. On the other hand, an Si content more than 0.25% by weight will result in a cast product having a reduced toughness. For an aluminum-based hypo-eutectic alloy composition, the Si content is set in a range of Si < 11.7% by weight.

Fe contributes to an increase in high-temperature strength of a cast product and a prevention of the seizure of the semi-molten material to the dies. However, if the Fe content is less than 0.9% by weight, the above effects are smaller. On the other hand, if the Fe content is more than 1.3% by weight, a cast product having a reduced elongation and a reduced toughness is produced.

Cu contributes to an increase in strength of a resulting cast product by precipitation of $Al_2Cu$ by a thermal treatment. However, if the Cu content is less than 1.9% by weight, the strength increasing effect is smaller. On the other hand, if the Cu content is more than 2.7% by weight, a cast product having a reduced corrosion resistance is produced.

Mg contributes to an increase in strength of a cast product by cooperation with Si. However, if the Mg content is less than 1.3% by weight, the strength increasing effect is smaller. On the other hand, a Mg content more than 1.8% by weight will result in a cast product having a reduced elongation and a reduced toughness.

Ni contributes to an increase in heat resistance of a cast product. However, if the Ni content is less than 0.9% by weight, the above effect is smaller. On the other hand, a Ni content more than 1.2% by weight will result in a cast product having a reduced elongation and a reduced toughness.

When the semi-molten material is produced from the secondary solid material, the heating conditions therefor are set in the following manner:

The average temperature rise rate R2 for the secondary solid material is set in a range of R2 $\geqq$ 0.2° C./sec; the soaking degree $\Delta T$ between inner and outer portions of the semi-molten material is set in a range of $\Delta T \leqq \pm 10°$ C.; and the viscosity $\mu$ of the semi-molten material is set in a range of 0.1 Pa·sec $\leqq \mu \leqq$ 2,000 Pa·sec. However, if the average temperature rise rate R2 for the secondary solid material is less than 0.2° C./sec, a long time is required for the preparation of the semi-molten material, thereby bringing about a coalescence of an intermetallic compound, resulting in a reduced moldability and a liability to wear the dies and further in deteriorated mechanical properties of a cast product.

The nature of the semi-molten material during passage through the gate 5 in a casting operation, i.e., the viscosity $\mu$ of the semi-molten material is set in a range of 0.1 Pa·sec $\leqq \mu \leqq$ 2,000 Pa·sec, and the Reynolds number Re is set in a range of Re $\leqq$ 1,500, both likewise as described above. The speed V of the semi-molten material is set in a range of 0.2 m/sec $\leqq$ V $\leqq$ 30 m/sec. If the speed V is set at a value in such range, the semi-molten material can be smoothly charged into the cavity 4 by a suitable pressurizing force. However, if the speed V is less than 0.2 m/sec, the time for charging the semi-molten material is prolonged, resulting in a reduced productivity. On the other hand, a speed V more than 30 m/sec lacks in practicality, because a large pressures is required, when the viscosity $\mu$ of the semi-molten material is high.

The sectional area increase rate Rs in the casting mold 1 is set in a range of Rs $\leqq$ 10, as described above. The pressurizing force P on the semi-molten material filled in the cavity 4 is set in a range of 10 MPa $\leqq$ P $\leqq$ 120 MPa, as described above.

A particular example will be described below.

First, an experiment as described below was conducted for the purpose of ascertaining an effect provided by an annealing treatment.

An ingot having an Al—Si based alloy composition as given in Table 10 was selected. This ingot was produced by a usual casting process and includes coarse grains and dendrites present in the metallographic structure thereof.

TABLE 10

| | Chemical constituent (% by weight) | | | | | |
|---|---|---|---|---|---|---|
| | Si | Fe | Cu | Mg | Ni | Al |
| Ingot | 0.2 | 1.1 | 2.3 | 1.5 | 1.1 | balance |

The ingot was subjected to a mechanical processing to fabricate a billet having a diameter of 240 mm and a length of 300 mm. The billet was subjected to a hot extrusion under conditions of an extrusion temperature of 400° C., a maximum pressurizing force of 2,500 tons and an extrusion ratio of 12 to comminute the coarse grains and dendrites, thereby preparing a primary solid material having a diameter of 70 mm and a granular crystalline structure with a directional property.

The primary solid material was placed into a heating furnace where it was subjected to a furnace-cooled annealing treatment at 450° C. for 2 hours, thereby producing a secondary solid material having a granular crystalline structure with the directional property eliminated by a recrystallization and the like.

The secondary solid material was placed into a low frequency induction heating furnace, where it was heated to 600° C. at an average temperature rise rate R2 equal to 1.3° C./sec, thereby producing a semi-molten material having a soaking degree (between inner and outer portions thereof) ΔT equal to 6° C. and a solid phase volume fraction Vf equal to 70%.

The semi-molten material was water-cooled to provide a solidified material, and its metallographic structure was examined.

Figure 9:
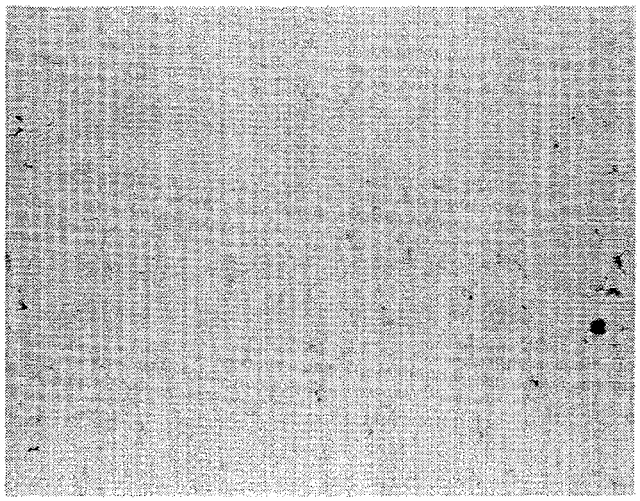
FIG. 9 is a photomicrograph showing a third example of a metallographic structure of a cast product.

FIG. 9 is a photomicrograph (100 magnifications) showing the metallographic structure of the solidified material. It can be seen from FIG. 9 that the metallographic structure of the solidified material has a dense and spheroidized granular crystalline texture having no directional property.

As a comparative example with no annealing treatment conducted, a semi-molten material having the same soaking degree ΔT and solid phase volume fraction Vf as those described above was produced by placing a primary solid material of the above-described type into a low frequency induction heating furnace, where it was heated under the same conditions as those described above, without any annealing treatment.

The semi-molten material was water-cooled to provide a solidified material as a comparative example, and its metallographic structure.

Figure 10:
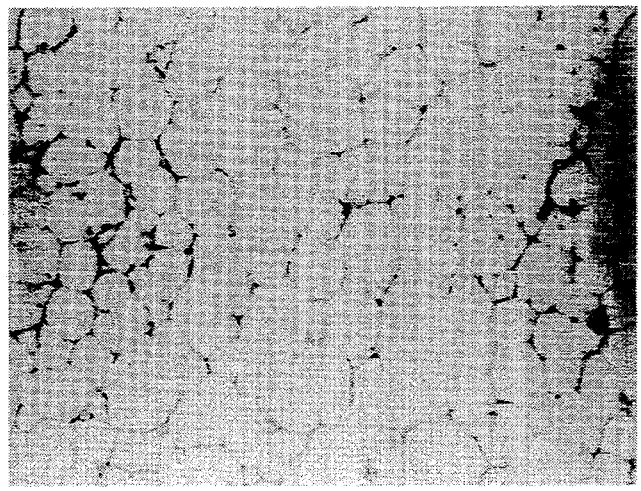
FIG. 10 is a photomicrograph showing a metallographic structure of a cast product in a comparative example.

FIG. 10 is a photomicrograph (100 magnifications) showing the metallographic structure of the solidified material as the comparative example. As is apparent from comparison of FIG. 10 with FIG. 9, it can be seen that the metallographic structure of the solidified material as the comparative example shown in FIG. 10 has a granular crystalline texture which is coarse and less spheroidized and moreover, which has a directional property.

A process for producing a cast product by casting will now be described.

In the casting mold 1, the sectional area increase rate Rs (S1/S0) established between the sectional area S0 of the gate 5 and the sectional area S1 of the inlet-side region 4*a* of the cavity 4 was set at 4 (Rs=4).

First, an ingot having an Al—Si base alloy composition as given above in Table 10 was selected. The ingot was produced by a usual casting process.

The ingot was subjected to a mechanical processing to fabricate a billet having a diameter of 240 mm and a length of 300 mm. The billet was subjected to a hot extrusion (a hot processing) under conditions of an extrusion temperature of 400° C., a maximum pressurizing force of 2,500 tons and an extrusion ratio of 12, thereby preparing a primary solid material having a diameter of 70 mm.

The primary solid material was placed into a heating furnace, where it was subjected to a furnace-cooled annealing treatment at 450° C. for 2 hours to produce a secondary solid material.

The secondary solid material was placed into a low frequency induction heating furnace, where it was heated to 600° C. at an average temperature rise rate R2 equal to 1.3° C./sec, thereby producing a semi-molten material having a soaking degree (between the inner and outer portions thereof) ΔT equal to 6° C. and a solid phase volume fraction Vf equal to 70%.

The semi-molten material was placed into a charging hole 6 in the casting hole 1 and was charged through the gate 5 into the cavity 4 by means of the plunger 9. In this case, the speed of movement of the plunger 9 was set at about 78 mm/sec; the speed V of the semi-molten material during passage through the gate 5 was 3.0 m/sec; the viscosity $\mu$ was 300 Pa·sec; and the Reynolds number Re was 0.21.

The behavior of semi-molten material charged was examined by measuring the starting point of rising of the temperature at the lower place G of the gate 5 in the mold 1, the upper and lower places U1 and L1 of the inlet-side region 4*a* and the upper and lower places U2 and L2 of the innermost region 4*c* of the cavity 4, as shown in FIG. 1. The result showed that the sequence of the places filled with the semi-molten material was G→L1→U1→L2 (U2 was substantially simultaneous with L2), which was ideal for avoiding the generation of cast defects.

The plunger 9 was maintained at the end of its stroke to apply a pressurizing force to the semi-molten material filled in the cavity 4, thereby solidifying the semi-molten material under the pressure to provide a cast product. In this case, it was confirmed that the pressurizing force P on the semi-molten material was 30~90 MPa, and flashes produced on a parting face 10 of the casting mold 1 were very few. The relationship between the time required for the above-described casting operation and the stroke of the plunger as well as the pressurizing force on the semi-molten material is the same as shown in FIG. 2.

The nature of the cast product produced in the above manner was visually observed. The result showed that any linear cracks and any pores due to the gas inclusion were not produced in the cast product, and any cutouts due to unfilling of the semi-molten material into the cavity 4 were also not produced in the cast product. Therefore, the cast product was proved to have a sound and dense metallographic structure and a high strength. This is attributable to the annealing treatment of the primary solid material to eliminate the directional property of the granular crystalline structure.

As a comparative example with no annealing treatment conducted, a semi-molten material having the same soaking degree ΔT and solid phase volume fraction Vf as those described above was produced by placing a primary solid material of the above-described type into a low frequency induction heating furnace, where it was heated under the same conditions as those described above, without any annealing treatment.

Using this semi-molten material, a cast product as a comparative example was produced under the same conditions as those in the above-described casting process.

The nature of the thus-produced cast product as the comparative example was visually observed. The result showed that there were linear cracks produced in the cast product. This is due to the directional property remaining in the solid phase in the semi-molten material.

[II] Process for casting of cast products having compositions of aluminum-based eutectic and hyper-eutectic alloys Alloys corresponding to the aluminum-based eutectic and hyper-eutectic alloys are Al—Si, Al—Mg, Al—Cu, Al—Ca, Al—Ga based eutectic and hyper-eutectic alloys and the like.

(1) Casting process using solid material made from ingot

An Al—Si based eutectic alloy used is, for example, one having a Si content of 11.7% by weight. And an Al—Si based hyper-eutectic alloy used is, for example, one having a Si content exceeding 11.7% by weight. The Al—Si based hyper-eutectic alloy has a composition which comprises, for example, 16.0% by weight-≦Si≦18.0% by weight; Fe≦0.50% by weight; 4.0% by weight≦Cu≦5.0% by weight; Mn≦1.0% by weight; 0.45% by weight≦Mg≦0.65% by weight; and Ti≦0.20% by weight.

Among these chemical constituents, Si contributes to an increase in wear resistance by precipitation of initial crystals Si. However, if the Si content is less than 16.0% by weight, the wear resistance increasing effect is reduced. On the other hand, any Si content more than 18.0% by weight will result in a deteriorated machineability.

Fe contributes to an increase in high temperature strength of a cast product and a prevention of any seizure of the semi-molten material to the casting mold, particularly, to the dies. The high temperature strength increasing mechanism is attributable to the buildup of dispersion of an AlFeMn intermetallic compound. However, the Fe content is more than 0.50% by weight, a resulting cast product has a reduced elongation and a reduced toughness.

Cu contributes to an increase in strength of a cast product by precipitation of $Al_2Cu$ by a thermal treatment. However, if the Cu content is less than 4.0% by weight, the strength increasing effect is smaller. On the other hand, if the Cu content is more than 5.0% by weight, a resulting cast product has a reduced corrosion resistance.

Mn contributes to an increase in high temperature strength of a cast product and has a function to cause the AlFe intermetallic compound to be rendered massive. However, if the Mn content is more than 1.0% by weight, a resulting cast product has a reduced elongation and a reduced toughness.

Mg contributes to an increase in strength of a cast product in cooperation with Si. However, if Mg content is less than 0.45% by weight, the strength increasing effect is smaller. And if the Mg content is more than 0.45% by weight, a resulting cast product has a reduced elongation and a reduced toughness.

Ti contributes to a reduction in size of crystal grains in the above-described range.

The maximum grain size d2 of initial crystals Si in the solid material used for preparation of the semi-molten material is set in a range of d2≦100 μm. If the maximum grain size d2 is set at a value in such range, it is possible to inhibit the wear of the movable and stationary dies 3 and 2, particularly, the sleeve 8 thereon during casting. The most preferable range of the maximum grain size d2 of the initial crystals Si is d2≦50 μm as described above.

Alternatively, a solid material may be used which has been produced by utilizing a molding and solidifying process using a quenched and solidified aluminum alloy powder and which has a maximum grain size d2 of the initial crystals Si less than 2 μm. Such a solid material has a composition comprising, for example, 17.0% by weight≦Si≦18.0% by weight; 2.0% by weight-≦Cu≦2.5% by weight; 0.3% by weight≦Mg≦ 0.5% by weight; 4.0% by weight≦Fe≦4.5% by weight; 1.8% by weight≦Mn≦2.2% by weight; and a balance is Al.

When a semi-molten material is produced from the solid material, the average temperature rise rate R2 for the solid material is in a range of R2≧0.2° C./sec; the soaking degree ΔT between inner and outer portions of the semi-molten material is in a range of ΔT≦±10° C.; and the viscosity μ of the semi-molten material is in a range of 0.1 Pa·sec≦μ≦2,000 Pa·sec, as described above.

The viscosity μ of the semi-molten material during the passage through the gate 5 in casting of a cast product is set in a range of 0.1 Pa·sec≦μ≦2,000 Pa·sec, and the Reynolds number Re is set in a range of Re≦1,500, as described above. The sectional area increase rate Rs in the casting mold 1 is set in a range of Rs≦10; the speed V of the semi-molten material during passage through the gate 5 is set in a range of 0.5 m/sec≦V≦20 m/sec; and the pressurizing force P on the semi-molten material filled in the cavity 4 is set in a range of 10 MPa≦P≦120 MPa, as described above.

A particular example will be described below.

A solid material of an Al—Si based hyper-eutectic alloy having a composition given in Table 11 was selected. This material has a metallographic structure with a maximum grain size d2 of initial crystals Si equal to 80 μm.

TABLE 11

| Chemical constituent (% by weight) | | | | | | | |
|---|---|---|---|---|---|---|---|
| Si | Fe | Cu | Mn | Mg | Zn | Ti | Al |
| 17.0 | 0.25 | 4.5 | 0.02 | 0.55 | 0.55 | 0.10 | balance |

In the casting mold 1, the sectional area increase rate Rs (S1/S0) established between the sectional area S0 of the gate 5 and the sectional area S1 of the inlet-side region 4a was set at 4 (Rs=4).

First, the solid material was placed into a heating furnace, and was then heated with an average temperature rise rate R2 set at 1.3° C./sec, thereby preparing a semi-molten material having a soaking ΔT equal to 6° C. between inner and outer portions and a solid phase volume fraction Vf of 70%. The solid phase has a metallographic structure similar to that of the previously-described solid material.

The semi-molten material was placed into the charging hole 6 in the casting mold 1 and was then charged through the gate 5 into the cavity 4 by means of the plunger 9. In this case, the speed of movement of the plunger 9 was set at about 78 mm/sec; the speed V of the semi-molten material during passage through the gate 5 was 3 m/sec; the viscosity μ of the semi-molten material was 300 Pa·sec, and the Reynolds number Re was 0.21.

The behavior of semi-molten material charged was examined by measuring the starting point of rising of the temperature at the lower place G of the gate 5 in the mold 1, the upper and lower places U1 and L1 of the inlet-side region 4a and the upper and lower places U2 and L2 of the innermost region 4c of the cavity 4, as shown in FIG. 1. The result showed that the sequence of the places filled with the semi-molten material was G→L1→U1→L2 (U2 was substantially simultaneous with L2), which was ideal for avoiding the generation of cast defects.

The plunger 9 was maintained at the end of its stroke to apply a pressurizing force to the semi-molten material filled in the cavity 4, thereby solidifying the semi-molten material under the pressure to provide a cast product A13. In this case, it was confirmed that the pressurizing force P on the semi-molten material was 30 MPa, and flashes produced on a parting face of the casting mold 1 were very few. The relationship between the time required for the above-described casting operation and the stroke of the plunger as well as the pressurizing force on the semi-molten material is the same as shown in FIG. 2.

Figure 11:
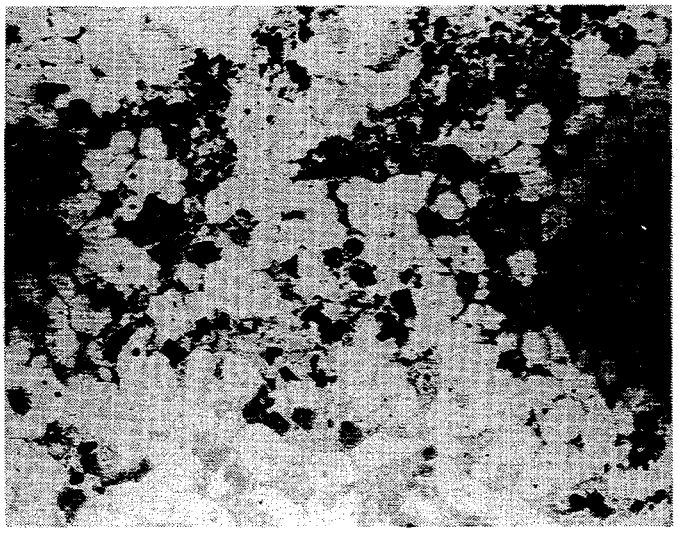
FIG. 11 is a photomicrograph showing a fourth example of a metallographic structure of a cast product.

FIG. 11 is a photomicrograph (100 magnifications) showing the metallographic structure of the cast product A13 produced by the above-described casting process.

In FIG. 11, each of black portions is an initial crystal Si, and it can be seen that the maximum grain size d2 of the initial crystals is 80 μm. The reason why such a metallographic structure is produced is that the maximum grain size d2 of the initial crystals in solid phases in the semi-molten material is 80 μm, and the reduction in size of the initial crystals precipitated from liquid phases is achieved, because the liquid phases receive a shearing force during passage through the gate 5 and solidified under the pressure.

As is apparent from FIG. 11, any cold shuts and any pores due to the gas inclusion were not produced in the cast product A13, and also, any cutouts due to the unfilling of the semi-molten material into the cavity 4 was not produced in the cast product A13, and therefore, this cast product A13 was proved to has an excellent cast quality.

For comparison, three cast products A14, B21 and B22 were produced under the same conditions as in the above-described casting process by using three solid materials of Al—Si based hyper-eutectic alloys having the same composition as that given in Table 11 and having maximum grain sizes d2 of initial crystals 100 μm, 150 μm and 200 μm, respectively.

In order to examine the toughness of each of the cast products A13, A14, B21 and B22, they were subjected to a T6 treatment and after such treatment, a Sharpy test was carried out for the cast products A13, A14, B21 and B22. The T6 treatment includes a primary heating step under conditions of 500° C. and 5 hours, a water cooling step and a secondary heating step under conditions of 180° C. and 5 hours.

In order to examine the situation of wearing of the sleeve 8, the casting operation using four solid materials of the above-described type was repeated 500 times under the same conditions, and the state of an inner surface of the sleeve 8 was visually observed. Table 12 shows results of the Sharpy test.

TABLE 12

| Cast product | Maximum size of initial crystals (μm) | Sharpy impact value (J/cm$^2$) | State of inner surface of sleeve |
|---|---|---|---|
| Example A13 | 80 | 0.50 | good |
| Example A14 | 100 | 0.47 | good |
| Comparative example B21 | 150 | 0.41 | presence of linear scratches |
| Comparative example B22 | 200 | 0.37 | presence of linear scratches |

As is apparent from Table 12, by setting the maximum grain size d2 of the initial crystals Si in the solid material, it is possible to produce cast products A13 and A14 having an excellent toughness, and to enhance the durability of the casting mold 1.

Then, cast products A15 and A16 as examples of the present invention and cast products B23 and B24 as comparative examples were produced in a casting process under the substantially same conditions, except that the speed V and the Reynolds number Re of the semi-molten material during passage through the gate 5 were changed by changing the speed of movement of the plunger 9.

Table 13 shows the relationship between the speed V and the Reynolds number Re for the cast products A13, A15 and A16 as the examples and the cast products B23 and B24 as the comparative examples.

TABLE 13

| Cast product | Semi-solidified material | |
|---|---|---|
| | Speed V (m/sec) | Reynolds number Re |
| A13 | 3 | 0.21 |
| A15 | 0.7 | 0.05 |
| A16 | 10 | 0.71 |
| B23 | 0.3 | 0.02 |
| B24 | 30 | 2.1 |

Figure 12:
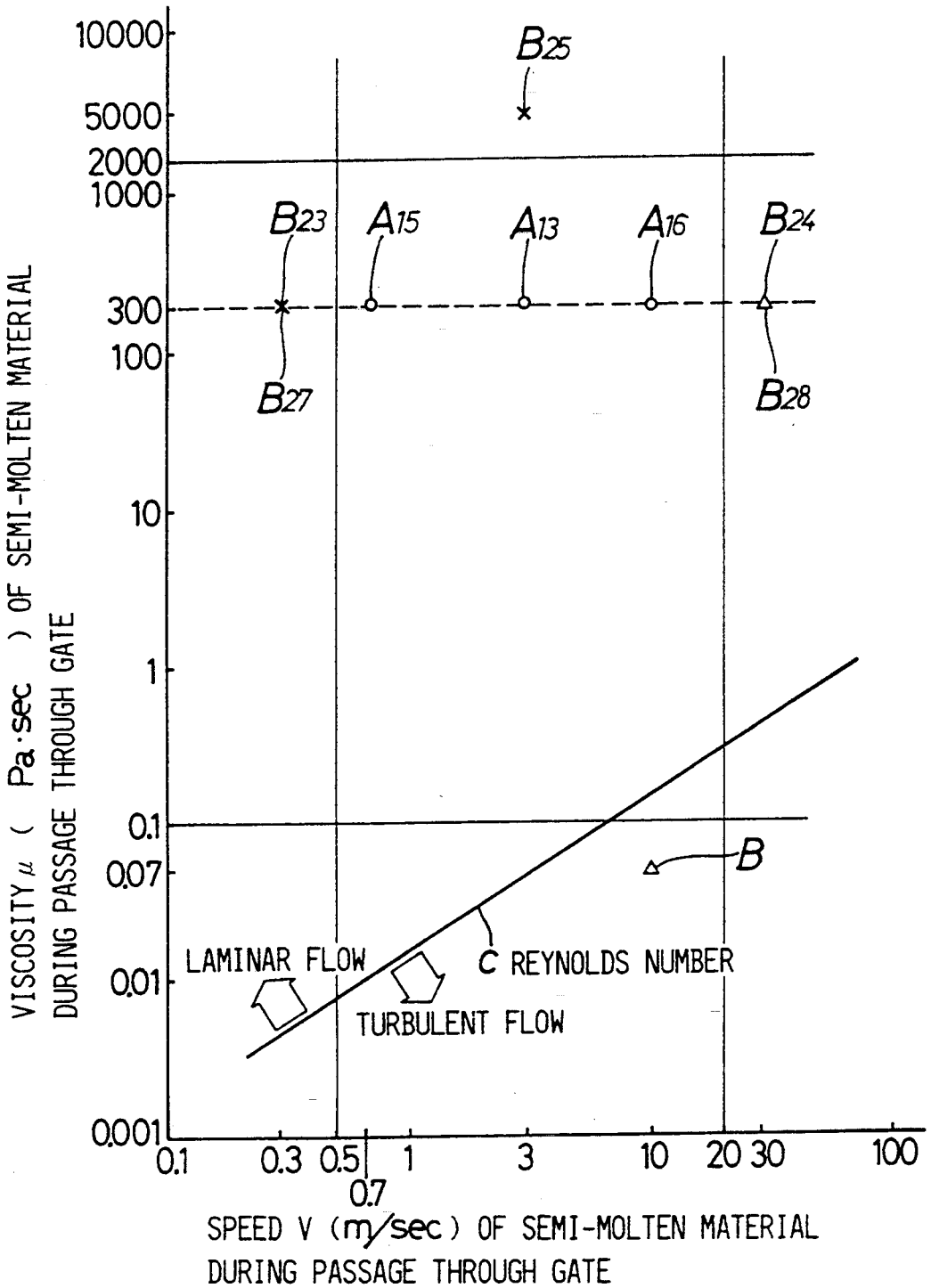
FIG. 12 is a graph illustrating the relationship between the speed and viscosity of a semi-molten material during passage through the gate.

FIG. 12 shows the relationship between the speed V of and the viscosity μ of the semi-molten material during passage through the gate 5. In FIG. 12, a line c corresponds to the case where the Reynolds number Re during passage through the gate 5 is 1,500. Therefore, a region including the line c and above the line c is a laminar flow region, and a region below the line c is a turbulent flow region.

Figure 13:
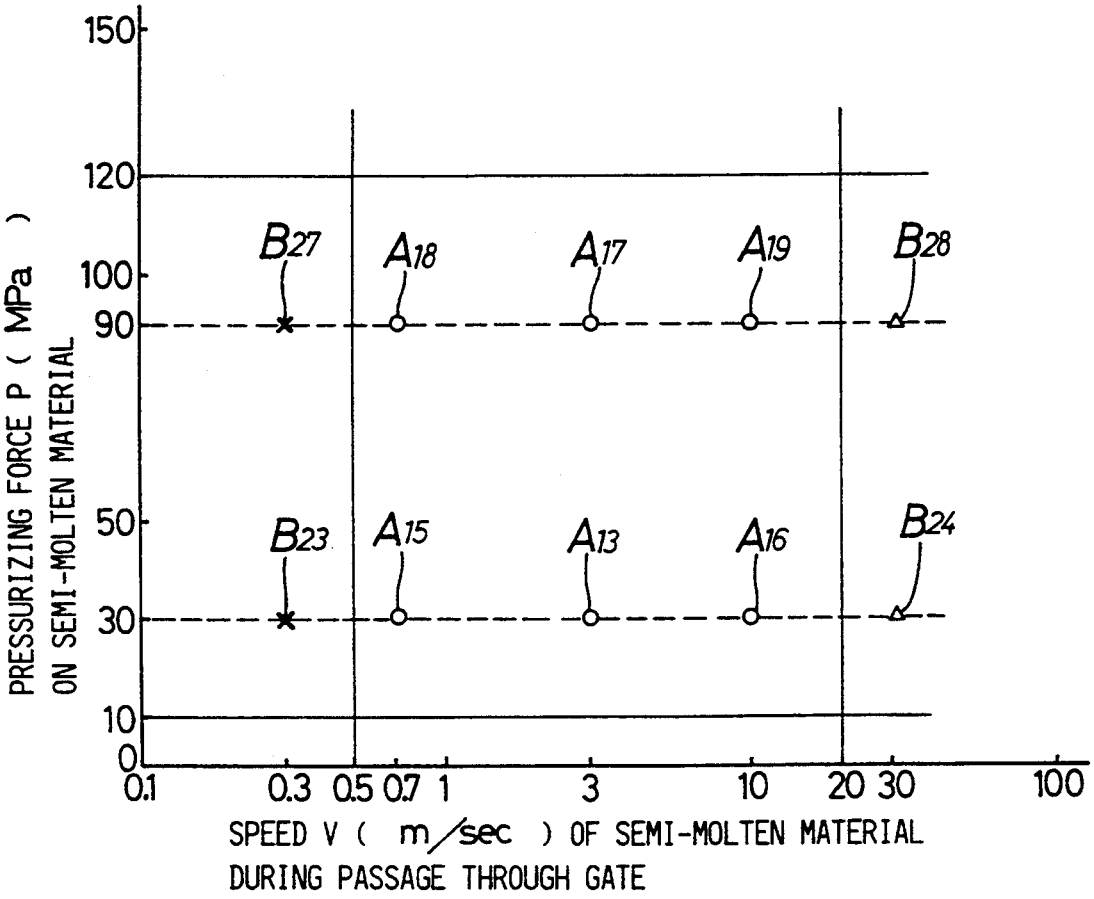
FIG. 13 is a graph illustrating the relationship between the speed of the semi-molten material during passage through the gate and the pressurizing force on the semi-molten material.

FIG. 13 shows the relationship between the speed V of the semi-molten material during passage through the gate 5 and the pressurizing force P on the semi-molten material filled in the cavity 4.

From the viewpoint of an increase in cast quality, as described above, it is preferable that the speed V is in a range of 0.5 m/sec≦V≦20 m/sec; the viscosity μ is in a range of 0.1 Pa·sec≦μ≦2,000 Pa·sec; the Reynolds number Re is in a range of Re≦1,500, and the pressurizing force P is in a range of 10 MPa≦P≦120 MPa.

It can be seen from Table 12 and FIGS. 12 and 13 that the above-described conditions are satisfied in the cast products A13, A15 and A16 as the examples.

In the cast product B23 as the comparative example, however, the speed V is less than the lower limit value (0.5 m/sec). For this reason, the sequence of charging of the semi-molten material into the cavity 4 was G→L1→U1→L2→U2. As a result, a portion unfilled with the semi-molten material was left in the upper place U2 in the innermost region 4c of the cavity 4, and correspondingly, a cutout was produced in the cast product B23.

In the cast product B24 as the comparative example, the speed V is more than the upper limit value (20 m/sec). For this reason, the sequence of charging of the semi-molten material into the cavity 4 was G→U2→L2→L1→U1. As a result, the semi-molten material was partially solidified early in the inlet-side region 4a and the innermost region 4c of the cavity 4, and correspondingly, cold shuts were produced in the cast product B24. In addition, it was confirmed that pores were produced in the cast product B24 due to the gas inclusion, because the semi-molten material was allowed to flow in a jet stream into the cavity 4.

For comparison, cast products B25 and B26 were produced by the substantially same casting process as described above, except that only the conditions given in Table 14 were changed. Both the cast products B25 and B26 are also shown in FIG. 12.

TABLE 14

| Cast product | Semi-molten material Speed V (m/sec) | Viscosity μ (Pa · sec) | Reynolds number Re |
|---|---|---|---|
| B25 | 3 | 5,000 | 0.01 |
| B26 | 10 | 0.07 | 3,000 |

In the cast product B25 as the comparative example, it was observed that cutouts were produced due to the increased viscosity of the semi-molten material. In the cast product B26 as the comparative example, it was observed that the gas inclusion occurred by the turbulent flow due to the decreased viscosity of the semi-molten material, and thus, pores were produced in the cast product B26.

For comparison, cast products A17, A18 and A19 corresponding to those A13, A15 and A16 as the examples of the present invention as well as cast products B27 and B28 corresponding to those B23 and B24 as the comparative examples were produced in the same casting process under the same conditions as those described above, except that the pressurizing force was set at 90 MPa. These cast products A17, A18, A19 are shown in FIG. 12 and products B27 and B28 are shown in FIG. 13. It was confirmed that they had cast qualities corresponding to those of the cast products A13, A15, A16, B23 and B24, respectively. More specifically, it was observed that no cast defects were produced in any of the cast products A17, A18 and A19, whereas cutouts were produced in the cast product B27, and cold shuts and pores were produced in the cast product B28.

(2) The case where a high density solid material produced by subjecting a quenched and solidified aluminum material alloy powder to a compacting and densifying process is used as a solid material In preparing a high density solid material, utilized as the compacting and solidifying process is either a compacting process utilized in a usual powder metallurgical process or a two-stage processing process in which a compacting step and a hot extrusion are conducted sequentially.

In preparing a semi-molten material, a low frequency induction heating furnace is used for purpose of achieving a soaking effect and a shortening of heating time.

In carrying out pressure die-casting process using the semi-molten material, an apparatus similar to that shown in FIG. 1 is used.

For example, a quenched and solidified aluminum material alloy powder produced by an atomization process is used and comprises the following chemical constituents:

17.0% by weight≦Si≦18.0% by weight,
2.0% by weight≦Fe≦4.5% by weight,
2.0% by weight≦Cu≦2.5% by weight,
1.8% by weight≦Mn≦2.2% by weight,
0.3% by weight≦Mg≦0.5% by weight, and
balance=aluminum The cooling rate R3 during production of the aluminum alloy powder is set equal to or more than $10^{2°}$ C./sec, which permits a formation of an aluminum alloy powder having a maximum grain size d2 of initial crystals Si equal to or less than 10 μm and a maximum grain size d3 of an intermetallic compound equal to or less than 15 μm. However, if the cooling rate R3 is less than $10^{2°}$ C./sec, it is failed to produce an aluminum alloy having a fine metallographic structure inherent in the quenching and solidifying process, and for this reason, it is difficult to control the viscosity in the preparation of the semi-molten material. The same can be said also when the maximum grain size d3 of the intermetallic compound exceeds 15 μm.

Among the chemical constituents of the aluminum alloy powder, Si has an effect to increase the wear resistance, Young's modulus and the like and to reduce the thermal expansion coefficient of a cast product. However, if the Si content is less than 17.0% by weight, such effect is smaller. But if the Si content is more than 18.0% by weight, the machineability is deteriorated.

Fe has an effect to increase the high temperature strength and Young's modulus of a cast product and to prevent a seizure of the semi-molten material to the casting mold 1. This high temperature strength increasing effect is attributable to a buildup of dispersion of an AlFeMn intermetallic compound. However, if the Fe content is less than 4. 0% by weight, such effect is smaller. On the other hand, if the Fe content is more than 4.5% by weight, a resulting cast product has a reduced elongation and a reduced toughness.

Cu has an effect to increase the strength of a cast product by precipitation of an $Al_2Cu$ intermetallic compound by a thermal treatment. However, if the Cu content is less than 2.0% by weight, the strength increasing effect is smaller. On the other hand, if the Cu content is more than 2.5% by weight, a resulting cast product has a reduced corrosion resistance.

Mn has an effect to increase the high temperature strength of a cast product and also has a function to cause the AlFe intermetallic compound to be rendered massive. However, if the Mn content is less than 1.8% by weight, such effect is smaller. On the other hand, if the Mn content is more than 2.2% by weight, a resulting cast product has a reduced elongation and a reduced toughness.

Mg has an effect to increase the strength of a cast product by cooperation with Si. However, if the Mg content is less than 0.3% by weight, the strength increasing effect is smaller. On the other hand, a Mg content more than 0.5% by weight will result in a cast product having a reduced elongation and a reduced toughness.

The relative density D of the solid material is set in a range as high as being represented by 70%≦D≦100%, as described above.

When the semi-molten material is produced from the solid material, heating conditions therefor are set as described below. The average temperature rise rate R2 for the solid material is set in a range of R2≧ 0.2° C./sec, as described above, for the purpose of preventing the coalescence of the intermetallic compound; the heating retention temperature T is set between a solid phase line temperature Ts and a liquid phase line temperature TL, i.e., in a range of Ts<T<TL; the heating retention time t is desirable to be short to a possible extent and may be set equal to or less than 30 minutes, depending upon the size of the solid material; the soaking degree ΔT in the semi-molten material is set equal to or less than 4° C.; and the viscosity μ of the semi-molten material is set in a range of 0.1 Pa·sec≦μ≦2,000 Pa·sec, as described above. If the heating conditions are set in this manner, it is possible to efficiently conduct the preparation and handling of the semi-molten material and to produce a cast product having an increased quality and improved mechanical properties.

It is desirable that the heating retention temperature T is equal to or less than Ts+0.5 (TL−TS)° C. If T>Ts+0.5 (TL−TS) ° C., a coalescence of the intermetallic compound is brought about to cause disadvantages similar to those described above. In addition, if the heating retention time t is more than 30 minutes, a coalescence of the intermetallic compound is likewise brought about.

Further, if the soaking degree ΔT in the semi-molten material is higher than 4° C., the viscosity μ in the semi-molten material is partially varied, thereby causing a melt-down portion to be created and also causing a unfilled place to be left in the cavity 4, thus bringing about a cutout produced in a resulting cast product. An optimal range for the soaking degree ΔT is equal to or less than 3° C. The reason is that in such a range, it is possible to automatically handle the semi-molten material, leading to an improved productivity of cast product.

The nature of the semi-molten material during passage through the gate 5 in a casting operation, i.e., the viscosity μ of the semi-molten material is set in a range of 0.1 Pa·sec≦μ≦2,000 Pa·sec; the Reynolds number Re is set equal to or less than 1,500, and the speed V of the semi-molten material during passage through the gate 5 is set in a range of 0.2 m/sec≦V≦30 m/sec, as described above. Further, the sectional area increase rate Rs is set equal to or less than 10, and the pressurizing force P on the semi-molten material filled in the cavity 4 is set in a range of 10 MPa≦P≦120 MPa, as described above.

A particular example will be described below.

First, the relationship between the relative density D of the solid material and the soaking degree ΔT of the semi-molten material will by considered below.

A quenched and solidified aluminum alloy powder having a composition given in Table 15 was selected.

TABLE 15

| Chemical constituent (% by weight) | | | | | |
|---|---|---|---|---|---|
| Si | Fe | Cu | Mn | Mg | Al |
| 17.5 | 4.2 | 2.2 | 2.0 | 0.4 | balance |

This aluminum alloy powder was produced by an atomization process, wherein the cooling rate R3 was $10^2 \sim 2\times10^4$° C./sec; the maximum grain size d2 of initial crystals Si was equal to or less than 100 μm; the maximum grain size d3 of an intermetallic compound was 7 μm; the solid phase line temperature T3 was 510° C., and the liquid phase line temperature TL was 690° C.

The aluminum alloy powder was subjected to a compacting step to form a green compact. Then, the green compact was subjected to a hot extrusion under conditions of an extrusion temperature of 420° C., a maximum pressurizing force of 2,500 tons and an extrusion ratio of 12, thereby providing a solid material having a relative density D equal to 100%.

The three solid materials having relative densities D of 90%, 80% and 70% were produced in the hot extrusion by varying the extrusion ratio.

Then, the solid materials were subjected to a mechanical processing to fabricate short columnar solid test pieces each having a diameter of 70 mm and a length of 100 mm.

Subsequently, the solid test pieces were placed into an aluminum crucible having an inside diameter of 70 mm and a depth of 100 mm. The crucible was is placed into a low frequency induction heating furnace, where the solid test pieces were heated up to 570° C. in an output pattern for rapidly heating the test piece in a soaking manner, thereby providing semi-molten test pieces. The temperature profile of each of the semi-molten materials was measured. For each of the semi-molten test pieces, a difference between the maximum and minimum values of the measured temperature was determined as a soaking degree ΔT, thereby providing results given in Table 16.

Each of comparative examples given in Table 16 is a semi-molten test piece prepared by placing an aluminum alloy of the above-described type into the crucible to provide a solid test piece having the same size as that described above, and subjecting the solid test piece to a heating treatment under the same conditions as those described above.

TABLE 16

| | Relative density D (%) of solid test piece | Soaking degree ΔT (°C.) of semi-molten test piece |
|---|---|---|
| Example | | |
| A20 | 100 | 3 |
| A21 | 90 | 3 |
| A22 | 80 | 3 |
| A23 | 70 | 4 |
| Comparative Example | | |
| B29 | 60 | 7 |
| B30 | 50 | 8 |

It can be seen from Table 16 that each of the semi-molten test pieces as examples of the present invention has an excellent soaking degree ΔT, as compared with the semi-molten test pieces as comparative examples. This is attributable to the use of the solid materials having the high relative density in the examples of the invention.

A process for producing a cast product using the above-described aluminum alloy powder will be described below.

First, the aluminum alloy powder was compacted to provide a green compact. Then, the green compact was subjected to a hot extrusion under conditions of an extrusion temperature of 420° C., a maximum pressurizing force of 2,500 tons and an extrusion ratio of 12, thereby providing a solid material.

In this solid material, particles of the aluminum alloy powder were sintered together, wherein the relative density D was 100%; the maximum grain size d2 of initial crystals Si was equal to or less than 100 μm, and the maximum grain size d3 of an intermetallic compound was 7 μm.

In the casting mold 1, the sectional area increase rate Rs (S1/S0) established between the sectional area S0 of the gate 5 and the sectional area S1 of the inlet-side region 4a of the cavity 4 was set at 4 (Rs=4).

Then, the solid material was placed into a low frequency induction heating furnace, wherein the average temperature rise rate R2 was set at 1.3° C./sec; the heating retention temperature T was set at 567° C., and the heating retention time t was set at 1 minute, thereby preparing a semi-molten material having a soaking degree ΔT of 3° C. and a solid phase volume fraction Vf of 70%. The solid phase has a metallographic structure similar to that of the previously-described solid material.

The semi-molten material was placed into the charging hole 6 in the casting mold 1 and charged through the gate 5 into the cavity 4 by means of the plunger 9. In this case, the speed of movement of the plunger 9 was set at about 78 mm/sec; the speed V of the semi-molten material during passage through the gate 5 was 3.0 m/sec; the viscosity $\mu$ was 300 Pa·sec, and the Reynolds number Re was 0.21.

The behavior of semi-molten material charged was examined by measuring a start point of rising of the temperature at a lower place G of the gate 5 in the casting mold 1, upper and lower places U1 and L1 of the inlet-side region 4*a* of the cavity 4 and upper and lower places U2 and L2 of the innermost region 4*c* of the cavity 4, as shown in FIG. 1. The result showed that the sequence of the places filled with the semi-molten material was G→L1→U1→L2 (U2 was substantially simultaneous with L2), which was ideal for avoiding the generation of cast defects.

The plunger 9 was maintained at an end of its stroke, thereby applying a pressurizing force to the semi-molten material filled in the cavity 4 to solidify the semi-molten material under the pressure, thus providing a cast product. In this case, it was confirmed that the pressurizing force P on the semi-molten material was of 30–90 MPa and flashes produced on the parting face 10 of the casting mold 1 were very few.

Figure 15:
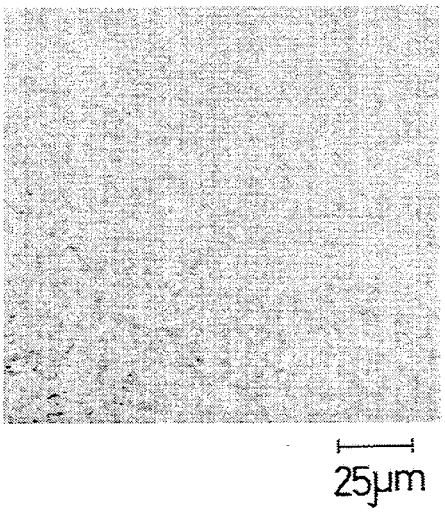
FIG. 15 is a photomicrograph showing a metallographic structure of a solid material.

FIG. 12 is a photomicrograph (200 magnifications) showing the metallographic structure of the cast product produced by the above-described pressure die-casting process. FIG. 15 is a photomicrograph (400 magnifications) showing the metallographic structure of the solid material.

In FIGS. 12 and 15, each of deep gray dot-like portions is an intermetallic compound. It can be seen from FIG. 14 that the maximum grain size d3 of the intermetallic compound is 15 $\mu$m and slightly larger than that shown in FIG. 15. The reason why such a metallographic structure is formed is that the maximum grain size d3 of the intermetallic compound in the solid phase of the semi-molten material is 7 $\mu$m, and the reduction in size of the intermetallic compound precipitated from the liquid phase is achieved, because the liquid phases are subjected to a shearing force during passage through the gate 5 and solidified under the pressure.

Figure 14:
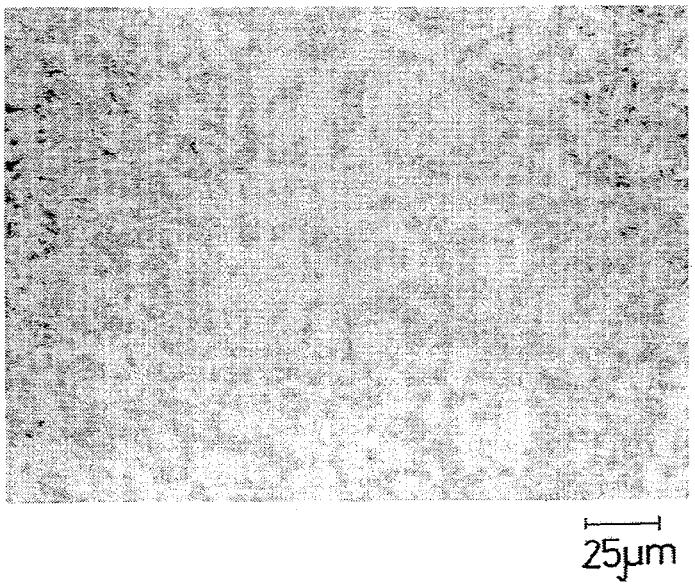
FIG. 14 is a photomicrograph showing a fifth example of a metallographic structure of a cast product.

In addition, as apparent from FIG. 14, any cold shuts and any pores due to a gas inclusion were not produced in this cast product, and also, any cutouts due to unfilling of the semi-molten material into the cavity 4 were not produced in the cast product. Therefore, the cast product was proved to have an excellent cast quality.

For the purpose of comparing the mechanical properties, the tensile strength $\sigma$ B and 0.2% proof strength of such cast product and such solid material (extruded material) were measured at room temperature, 200° C. and 300° C. The results are shown in Table 17.

TABLE 17

| | Tensile strength $\sigma$B (MPa) | | | 0.2% proof strength $\sigma$0.2 (MPa) | | |
|---|---|---|---|---|---|---|
| | R.T. | 200° C. | 300° C. | R.T. | 200° C. | 300° C. |
| Cast product | 355 | 338 | 131 | 303 | 296 | 98 |
| Solid material | 525 | 358 | 107 | 384 | 321 | 86 |

As is apparent from Table 17, the solid material is slightly more excellent in strength than the cast product at room temperature, but the solid material and the cast product have the substantially same levels of strength at increased temperatures.

Therefore, according to the above-described pressure die-casting process, it is possible to provide a cast product having an excellent high temperature strength and an increased shape freedom, as compared with a hot extrusion.

For comparison, an aluminum alloy powder of the above-described type was placed into the crucible to prepare a solid material having a relative density D of 60%, and the crucible was placed into a low frequency induction heating furnace, where the solid material was heated under the same heating conditions as those described above, thereby preparing a semi-molten material having a soaking degree $\Delta T$ of 7° C. and a solid phase volume fraction Vf of 70%. The semi-molten material was placed into the charging hole 6 in the casting mold 1 and subjected to a casting under the same casting conditions as those described above, thereby providing a cast product as a comparative example.

Figure 16:
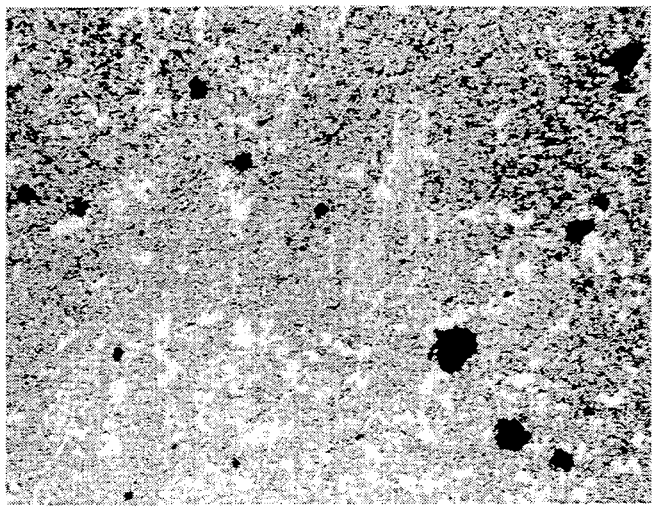
FIG. 16 is a photomicrograph showing a metallographic structure of a cast product in a comparative example.

FIG. 16 is a photomicrograph (100 magnifications) showing the metallographic structure of the cast product as the comparative example. It can be seen from FIG. 16 that the cast product as the comparative example has shrinkage voids (black portions) formed therein. The formation of the cavities is due to the low relative density of the solid material and to the presence of an infinite number of voids in the solid material.

What is claimed is:

1. A process for producing an aluminum-based alloy cast product by casting, comprising the steps of: preparing a casting material having an aluminum-based hypo-eutectic alloy composition in which solid and liquid phases coexist; and casting said casting material under pressure; at the casting step, said casting material being passed through a gate in a casting mold under conditions of a viscosity $\mu$ of the casting material in a range of 0.1 Pa·sec$\leqq\mu\leqq$2,000 Pa·sec and a Reynolds number Re equal to or less than 1,500.

2. A process for producing an aluminum-based alloy cast product according to claim 1, wherein the speed V of said casting material during passage through said gate is in a range of 0.5 m/sec$\leqq$V$\leqq$20 m/sec, and the pressurizing force P on said casting material filled into a cavity in said casting mold is in a range of 10 MPa$\leqq$P$\leqq$120 MPa.

3. A process for producing an aluminum-based alloy cast product according to claim 1 or 2, wherein said casting material is a semi-solidified material prepared by cooling a molten metal of an aluminum hypo-eutectic alloy composition, and in the preparation of said semi-solidified material, the average temperature drop rate R1 of said molten metal is set in a range of 0.1° C./sec$\leqq$R1$\leqq$10° C./sec.

4. A process for producing an aluminum-based alloy cast product according to claim 3, wherein if a sectional area of said gate and a sectional area of an inlet-side region of said cavity are represented by S0 and S1, respectively, and if a sectional area increase rate Rs is represented by S1/S0, the sectional area increase rate Rs is set equal to or less than 10.

5. An aluminum-based alloy cast product having a hypo-eutectic alloy composition produced by the process according to claim 1 or 2, comprising a metallographic structure in which an area rate Ra of initial crystals α-Al having a shape factor F equal to or more than 0.1 is set equal to or more than 80%, and in which the maximum grain size d1 of said initial crystals α-Al is set equal to or less than 300 μm.

6. A process for producing an aluminum-based alloy cast product according to claim 1 or 2, wherein said casting material is a semi-molten material prepared by heating a solid material made of aluminum-based hypo-eutectic alloy, said solid material being one whose area rate Ra of initial crystals α-Al having a shape factor F equal to more than 0.1 is set equal to or more than 80%.

7. A process for producing an aluminum-based alloy cast product according to claim 6, wherein if a sectional area of said gate and a sectional area of an inlet-side region of said cavity are represented by S0 and S1, respectively, and if a sectional area increase rate Rs is represented by S1/S0, the sectional area increase rate Rs is set equal to or less than 10.

8. A process for producing an aluminum-based alloy cast product according to claim 7, wherein the average temperature rise rate R2 of said solid material is equal to or more than 0.2° C./sec, and a soaking degree ΔT between inner and outer portions of said semi-molten material is in a range of $\Delta T \leqq \pm 10°$ C.

9. A process for producing an aluminum-based alloy cast product according to claim 6, wherein the maximum grain size d1 of initial crystals α-Al in said solid material is equal to or less than 300 μm.

10. A process for producing an aluminum-based alloy cast product according to claim 1, wherein said casting material is a semi-molten material having solid and liquid phases coexisting therein, and wherein said semi-molten material is produced by; subjecting an ingot to either a hot processing or a cold processing to prepare a primary solid material having a granular crystalline structure with a directional property; subjecting said primary solid material to an annealing treatment to prepare a secondary solid material having a granular crystalline structure with said directional property eliminated; and heating said secondary solid material.

11. A process for producing an aluminum-based alloy cast product according to claim 10, wherein the speed V of said semi-molten material during passage through said gate is in a range of $0.2 \text{ m/sec} \leqq V \leqq 30 \text{ m/sec}$, and the pressurizing force P on said semi-molten material filled in said cavity is in a range of $10 \text{ MPa} \leqq P \leqq 120$ MPa.

12. A process for producing an aluminum-based alloy cast product according to claim 11, wherein when the semi-molten material is produced from said secondary solid material, the average temperature rise rate R2 of said secondary solid material is equal to or more than 0.2° C./sec, and a soaking degree ΔT between inner and outer portions of said semi-molten material is in a range of $\Delta T \leqq \pm 10°$ C.

13. A process for producing an aluminum-based alloy cast product according to claim 12, wherein if a sectional area of said gate and a sectional area of an inlet-side region of said cavity are represented by S0 and S1, respectively, and if a sectional area increase rate Rs is represented by S1/S0, the sectional area increase rate Rs is set equal to or less than 10.

14. An aluminum-based alloy cast product having a hypo-eutectic alloy composition produced by the process according to claim 3, comprising a metallographic structure in which an area rate Ra of initial crystals α-Al having a shape factor F equal to or more than 0.1 is set equal to or more than 80% and in which the maximum grain size d1 of said initial crystals α-Al is set equal to or less than 300 μm.

15. An aluminum-based alloy cast product having a hypo-eutectic alloy composition produced by the process according to claim 4, comprising a metallographic structure in which an area rate Ra of initial crystals α-Al having a shape factor F equal to or more than 0.1 is set equal to or more than 80%, and in which the maximum grain size d1 of said initial crystals α-Al is set equal to or less than 300 μm.

16. A process for producing an aluminum-based alloy cast product by casting, comprising the steps of: heating a solid material of either an aluminum-based eutectic alloy or an aluminum-based hyper-eutectic alloy to prepare a semi-molten material having solid and liquid phases coexisting therein; and charging said semi-molten material through a gate of a casting mold into a cavity under pressure, wherein the maximum grain size d2 of initial crystals of said solid material is equal to or less than 100 μm.

17. A process for producing an aluminum-based alloy cast product according to claim 16, wherein said semi-molten material is passed through said gate under conditions of a viscosity μ of the semi-molten material in a range of $0.1 \text{ Pa·sec} \leqq \mu \leqq 2{,}000$ Pa·sec and a Reynolds number Re equal to or less than 1,500.

18. A process for producing an aluminum-based alloy cast product according to claim 16 or 17, wherein a speed V of said semi-molten material during passage through said gate is in a range of $0.5 \text{ m/sec} \leqq V \leqq 20$ m/sec, and a pressurizing force P on said semi-molten material filled in said cavity is in a range of $10 \text{ MPa} \leqq P \leqq 120$ MPa.

19. A process for producing an aluminum-based alloy cast product according to claim 18, wherein if a sectional area of said gate and a sectional area of an inlet-side region of said cavity are represented by S0 and S1, respectively, and if a sectional area increase rate Rs is represented by S1/S0, the sectional area increase rate Rs is set equal to or less than 10.

20. A process for producing an aluminum-based alloy cast product according to claim 19, wherein the average temperature rise rate R2 of said solid material is equal to or more than 0.2° C./sec, and the soaking degree ΔT between inner and outer portions of said semi-molten material is in a range of $\Delta T \leqq \pm 10°$ C.

21. A process for producing an aluminum-based alloy cast product according to claim 16, wherein said solid material is a high density solid material produced by subjecting a quenched and solidified aluminum alloy powder to a forming and densifying process.

22. A process for producing an aluminum-based alloy cast product according to claim 21, wherein the maximum grain size d3 of an intermetallic compound in said quenched and solidified aluminum alloy powder is equal to or less than 15 μm.

23. A process for producing an aluminum-based alloy cast product according to claim 22, wherein the relative density D of said high density solid material is in a range of $70\% \leqq D \leqq 100\%$.

24. A process for producing an aluminum-based alloy cast product according to claim 21, 22 or 23, wherein said semi-molten material is passed through said gate under conditions of a viscosity μ of the semi-molten material in a range of $0.1 \text{ Pa·sec} \leqq \mu \leqq 2{,}000$ Pa·sec and a Reynolds number Re equal to or less than 1,500.

25. A process for producing an aluminum-based alloy cast product according to claim 24, wherein a speed V of said semi-molten material during passage through said gate is in a range of 0.2 m/sec≦V≦30 m/sec, and a pressurizing force P on said semi-molten material filled in said cavity is in a range of 10 MPa≦P≦120 MPa.

26. A process for producing an aluminum-based alloy cast product according to claim 25, wherein if a sectional area of said gate and a sectional area of an inlet-side region of said cavity are represented by S0 and S1, respectively, and if a sectional area increase rate Rs is represented by S1/S0, the sectional area increase rate Rs is set equal to or less than 10.

27. A process for producing an aluminum-based alloy cast product according to claim 26, wherein the average temperature rise rate R2 of said solid material is equal to or more than 0.2° C./sec; heating to a retention temperature T in a range of TS<T<TL wherein TS represents a solid phase line temperature, and TL represents a liquid phase line temperature; maintaining in a heating retention time t for equal to or less than 30 minutes; and the soaking degree ΔT between inner and outer portions of said semi-molten material is equal to or less than 4° C.

* * * * *